US011363859B2

(12) United States Patent
Tung et al.

(10) Patent No.: US 11,363,859 B2
(45) Date of Patent: Jun. 21, 2022

(54) SLIDE FASTENER

(71) Applicant: YKK CORPORATION, Tokyo (JP)

(72) Inventors: Yu Chen Tung, Toyama (JP); Shigeyoshi Takazawa, Toyama (JP); Yoshinori Kojima, Toyama (JP)

(73) Assignee: YKK CORPORATION, Tokyo (JP)

( * ) Notice: Subject to any disclaimer, the term of this patent is extended or adjusted under 35 U.S.C. 154(b) by 29 days.

(21) Appl. No.: 16/614,071

(22) PCT Filed: May 7, 2018

(86) PCT No.: PCT/JP2018/019194
§ 371 (c)(1),
(2) Date: Nov. 15, 2019

(87) PCT Pub. No.: WO2018/212304
PCT Pub. Date: Nov. 22, 2018

(65) Prior Publication Data

US 2020/0345110 A1 Nov. 5, 2020

(30) Foreign Application Priority Data

May 19, 2017 (WO) ..... PCT/JP2017/018926

(51) Int. Cl.
*A44B 19/10* (2006.01)
*A44B 19/26* (2006.01)

(52) U.S. Cl.
CPC ..... *A44B 19/267* (2013.01)

(58) Field of Classification Search
CPC ..... A44B 19/267
See application file for complete search history.

(56) References Cited

U.S. PATENT DOCUMENTS 1,692,196 A * 11/1928 Blair ..... A44B 19/04 24/411
1,745,116 A 1/1930 Pipes
2,731,671 A 1/1956 Zimmerman
(Continued)

FOREIGN PATENT DOCUMENTS

BE 452378 A 3/1944
CN 102665476 A * 9/2012 ..... A44B 19/36
(Continued)

OTHER PUBLICATIONS

International Preliminary Report on Patentability for related PCT App No. PCT/JP2018/019194 dated Nov. 21, 2019, 6 pgs.
(Continued)

*Primary Examiner* — Jason W San
(74) *Attorney, Agent, or Firm* — Procopio, Cory, Hargreaves & Savitch LLP

(57) ABSTRACT

Fastener element of slide fastener has an intermediate portion including bent or curved portion between a terminal portion and a base portion. The intermediate portion has an engaging protrusion and an engaged recess which are respectively protruded and recessed on an axis that matches a movement direction of the slider. In an orthogonal direction orthogonal to the axis, a first distance between the axis and the terminal surface of the terminal portion is less than a second distance between the axis and the base end surface of the base portion.

20 Claims, 34 Drawing Sheets

(56) References Cited

U.S. PATENT DOCUMENTS

| | | | | | |
|---|---|---|---|---|---|
| 4,140,157 | A * | 2/1979 | Scott | A44B 19/14 | 139/384 B |
| 4,418,449 | A * | 12/1983 | Heimberger | A44B 19/06 | 24/401 |
| 4,639,981 | A * | 2/1987 | Yoshida | A44B 19/14 | 24/401 |
| 4,651,388 | A * | 3/1987 | Horikawa | A44B 19/06 | 24/409 |
| 4,675,951 | A * | 6/1987 | Hasegawa | A44B 19/14 | 24/408 |
| 5,394,593 | A * | 3/1995 | Aoki | A44B 19/06 | 24/411 |
| 7,337,506 | B2 * | 3/2008 | Kusayama | B29D 5/02 | 24/389 |
| 7,870,649 | B2 * | 1/2011 | Mikuma | A44B 19/04 | 24/413 |
| 2008/0209695 | A1 | 9/2008 | Matsui et al. | | |
| 2013/0133161 | A1 * | 5/2013 | Ren | A44B 19/303 | 24/434 |

FOREIGN PATENT DOCUMENTS

| | | | | |
|---|---|---|---|---|
| CN | 105530828 | A * | 4/2016 | A44B 19/24 |
| CN | 102665476 | A | 9/2021 | |
| EP | 2545799 | A1 | 1/2013 | |
| EP | 3045068 | A1 | 7/2016 | |
| FR | 1136227 | A | 5/1957 | |
| GB | 442809 | A | 2/1936 | |
| JP | 131149 | C2 | 2/1939 | |
| JP | S32-3337 | Y1 | 5/1957 | |
| JP | 2008-212352 | A | 9/2008 | |
| WO | 2010106620 | A1 | 9/2010 | |

OTHER PUBLICATIONS

Extended European Search Report for related EP App No. 18802800.5 dated Feb. 26, 2020, 9 pgs.

International Search Report for related International Application No. PCT/JP2018/019194, dated Jul. 3, 2018; 4 pages; English translation of ISR provided.

Communication Pursuant to Article 94(3) EPC for related EP App No. 19207391.4 dated Mar. 15, 2021, 5 pgs.

Office Action dated Aug. 9, 2021 from corresponding Chinese patent application No. 201880032671.2, 16 pages.

* cited by examiner

[Fig. 1]
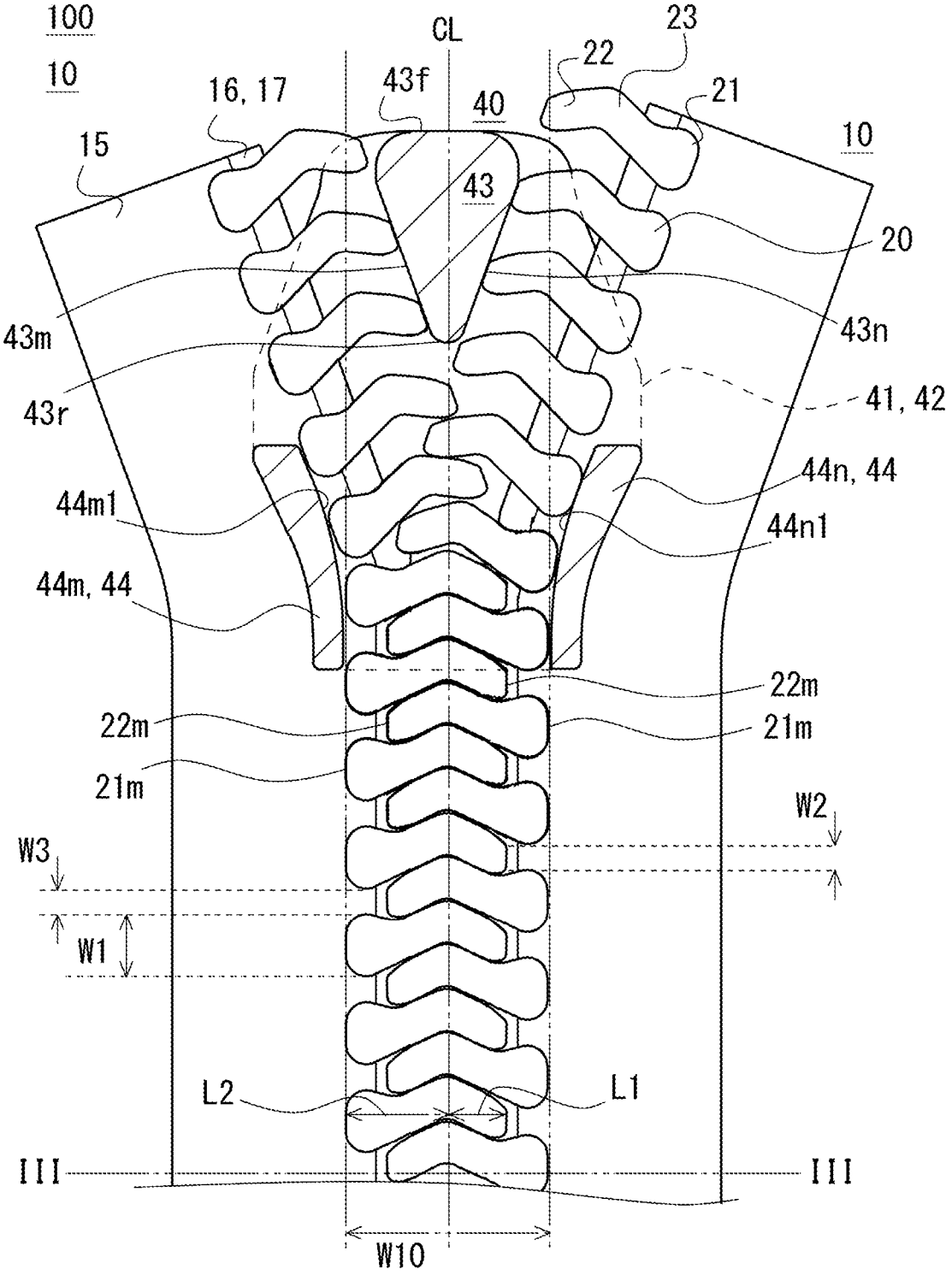

[Fig. 2]
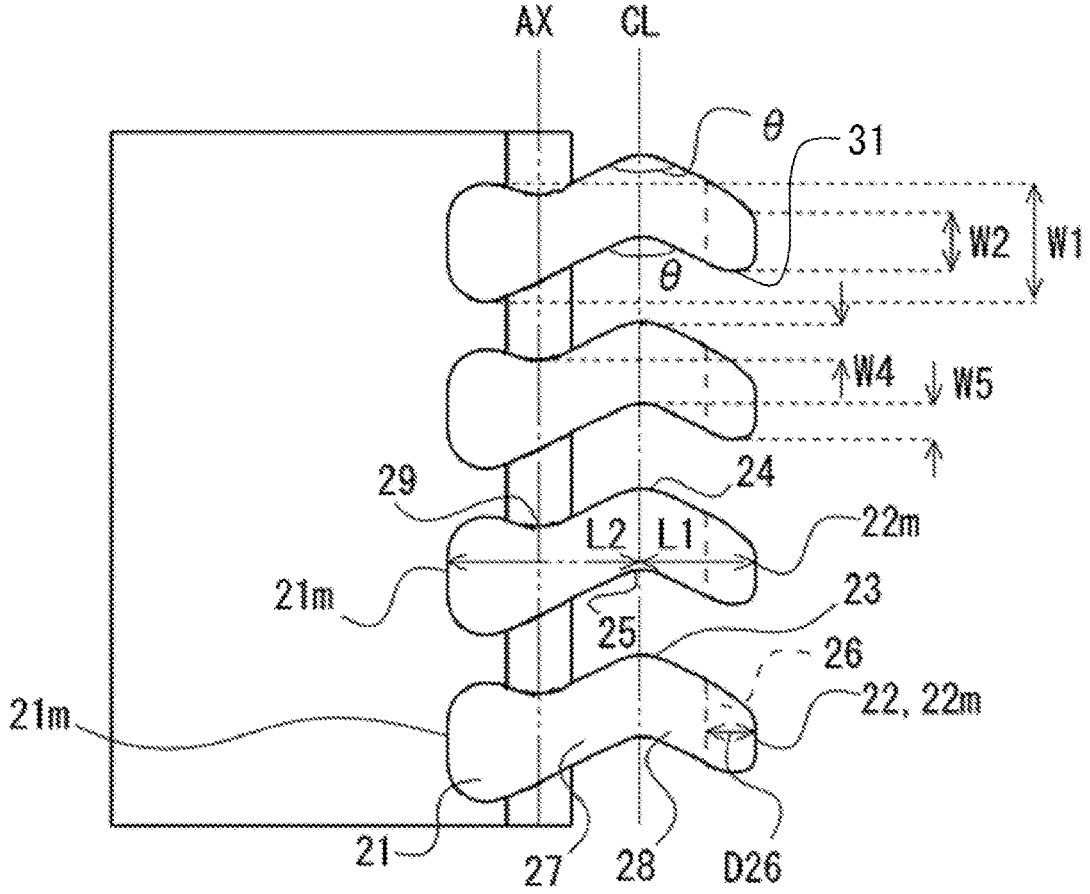

[Fig. 3]
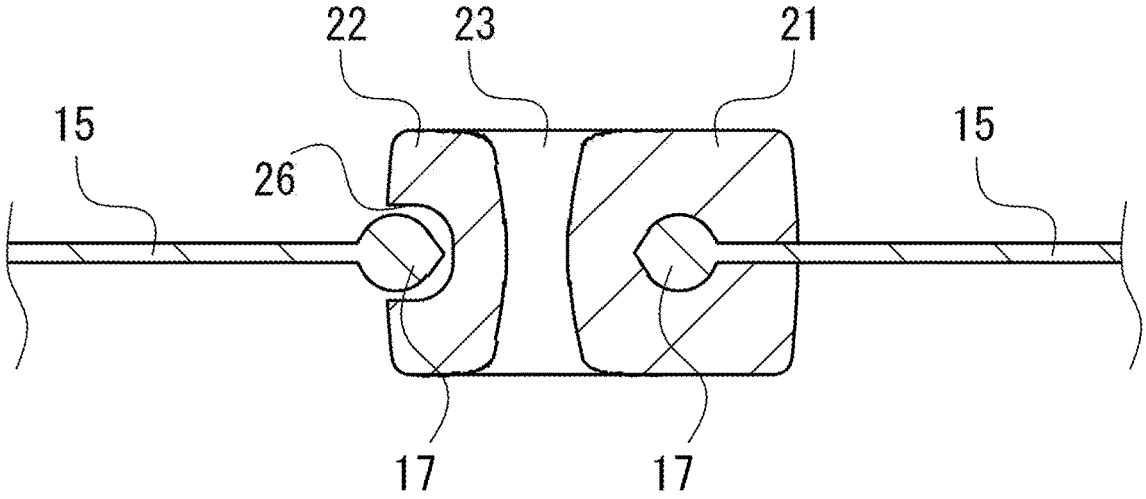

[Fig. 4]
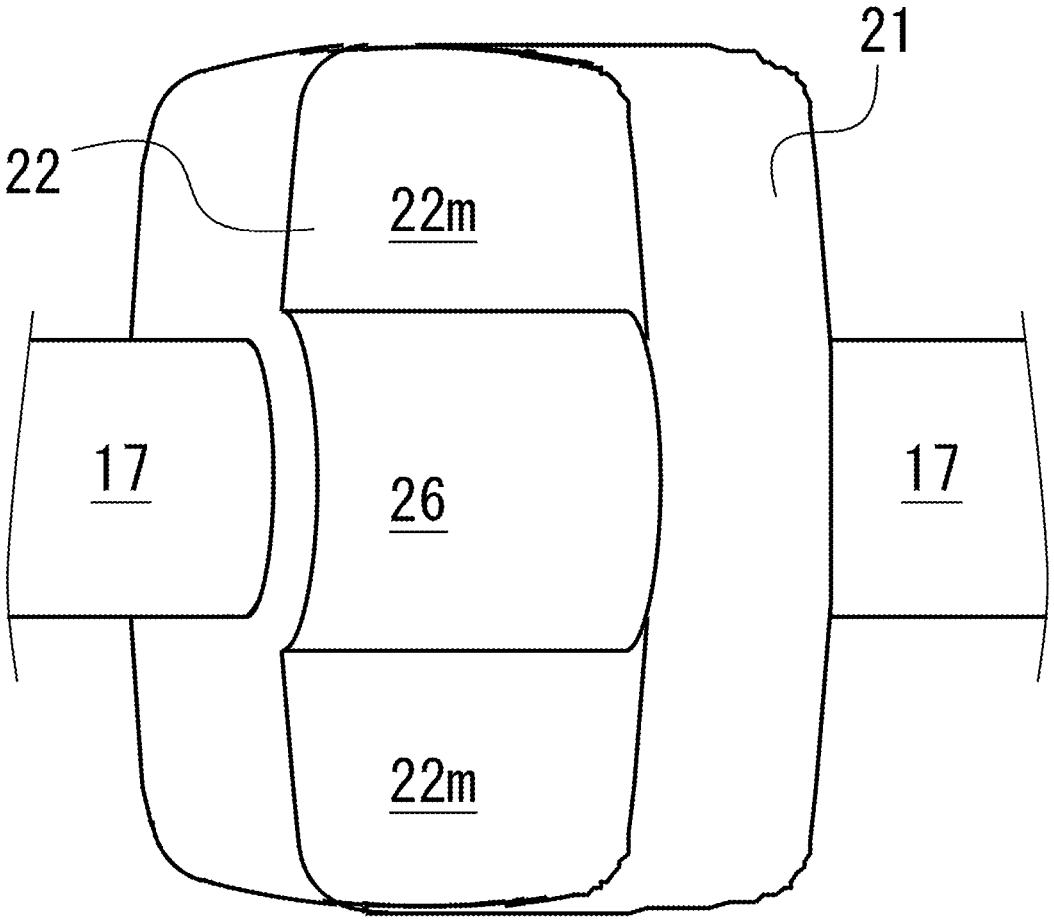

[Fig. 5]
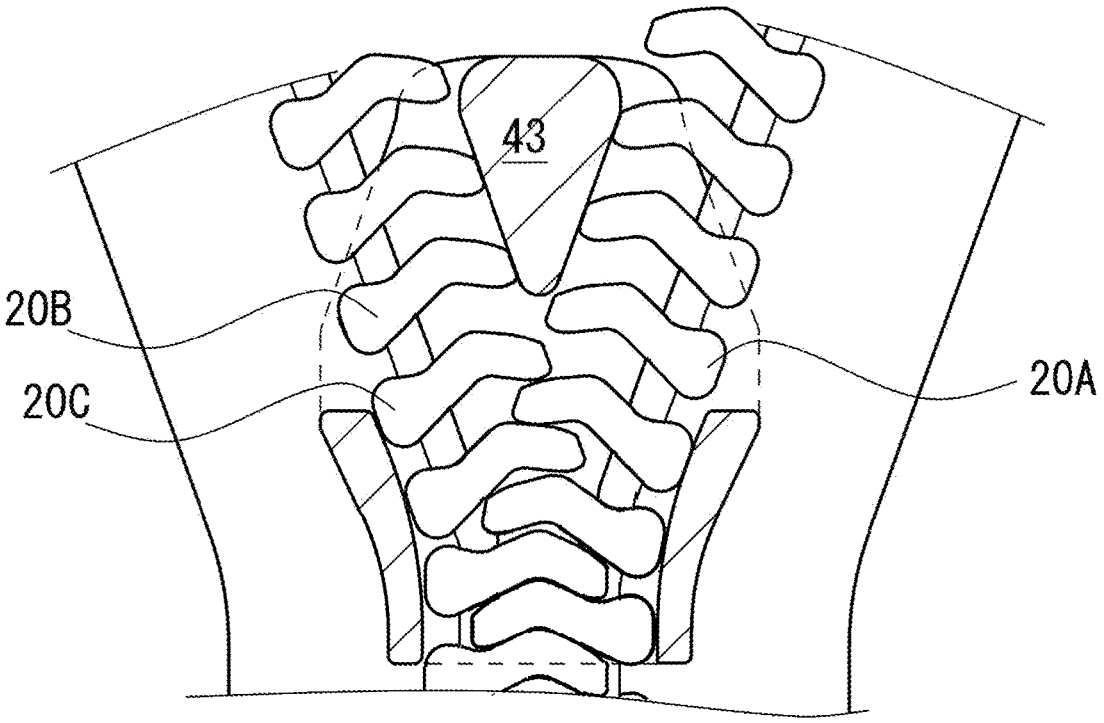

[Fig. 6]
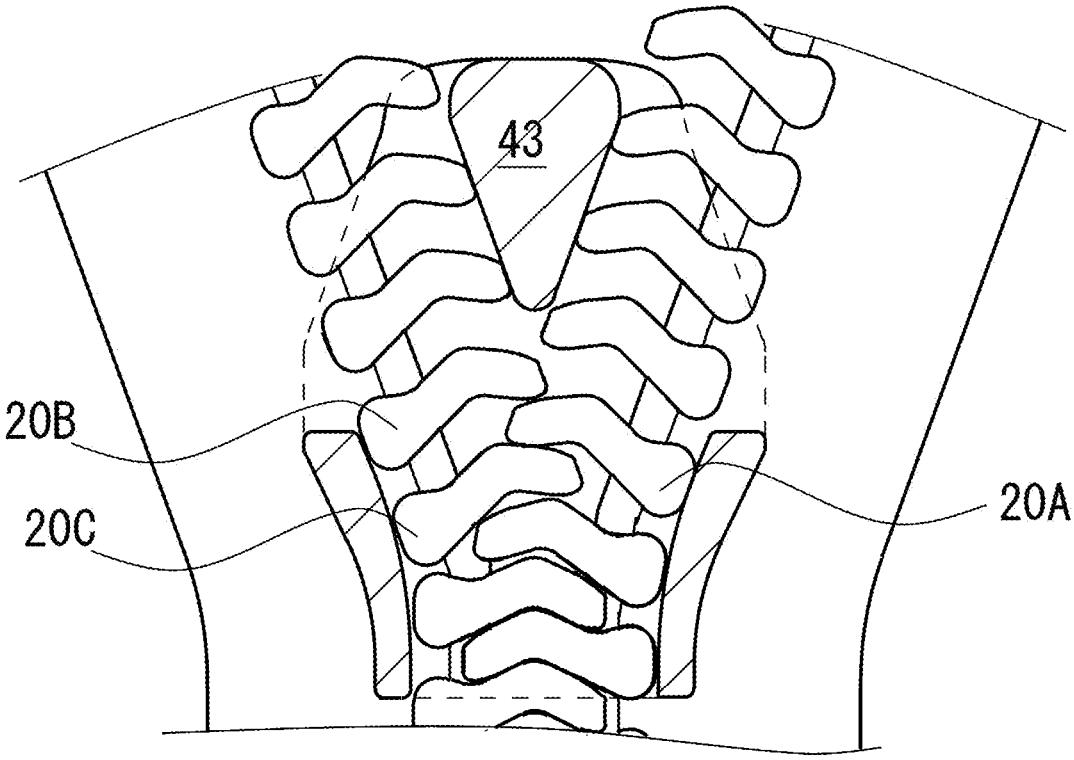

[Fig. 7]
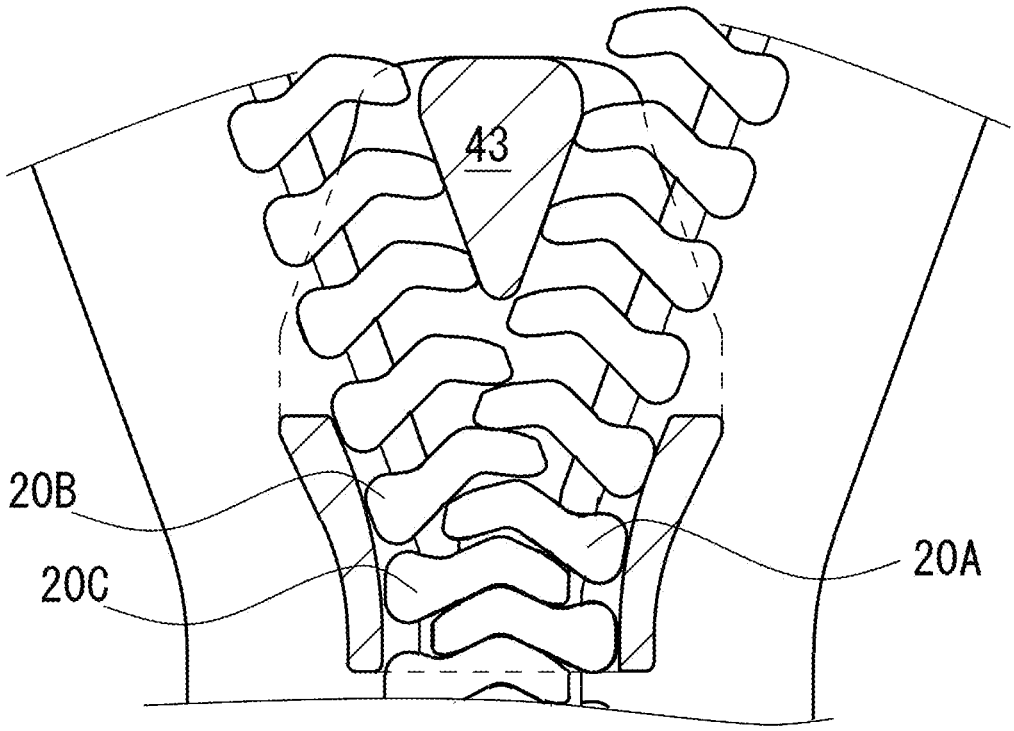

[Fig. 8]
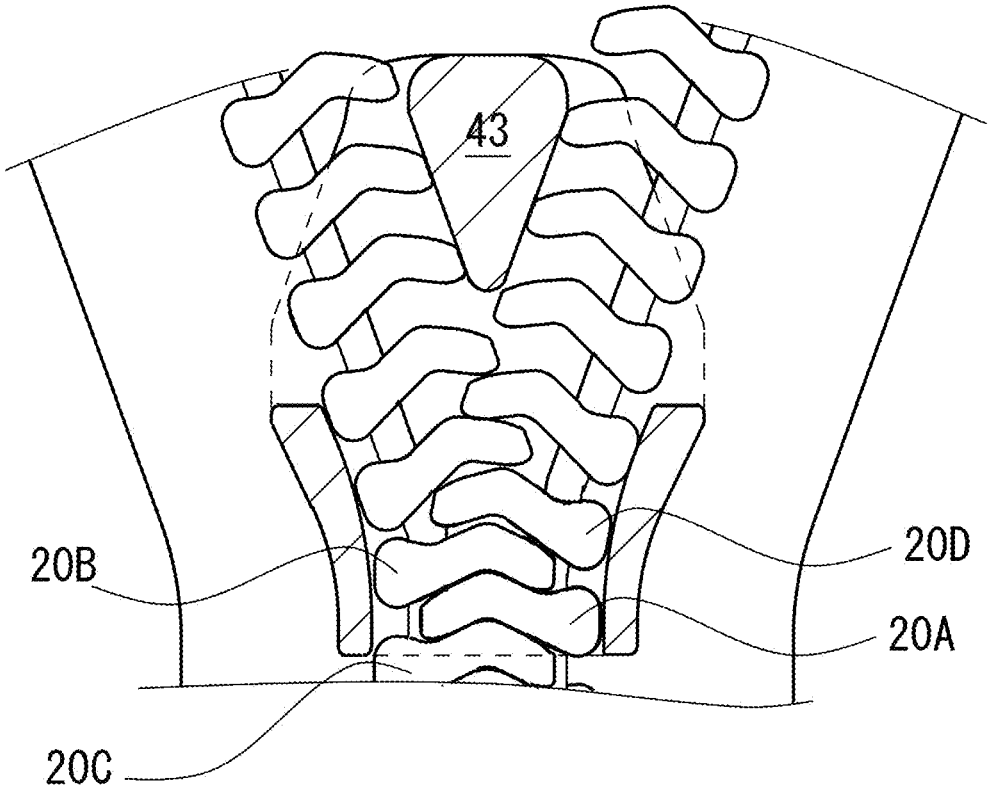

[Fig. 9]
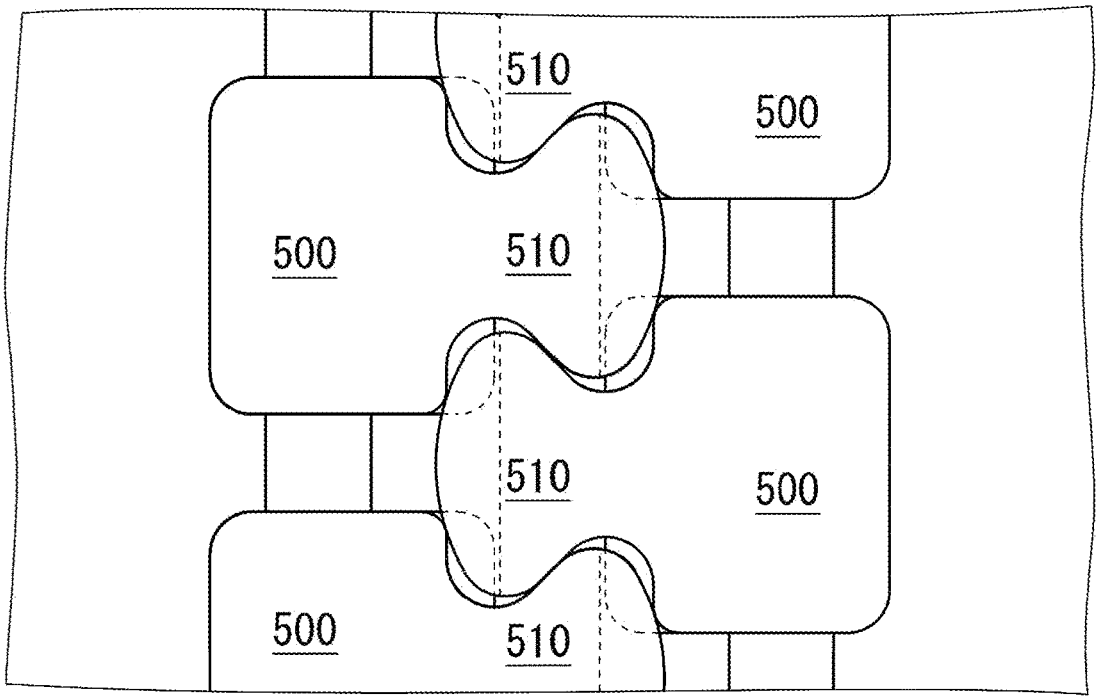

[Fig. 10]
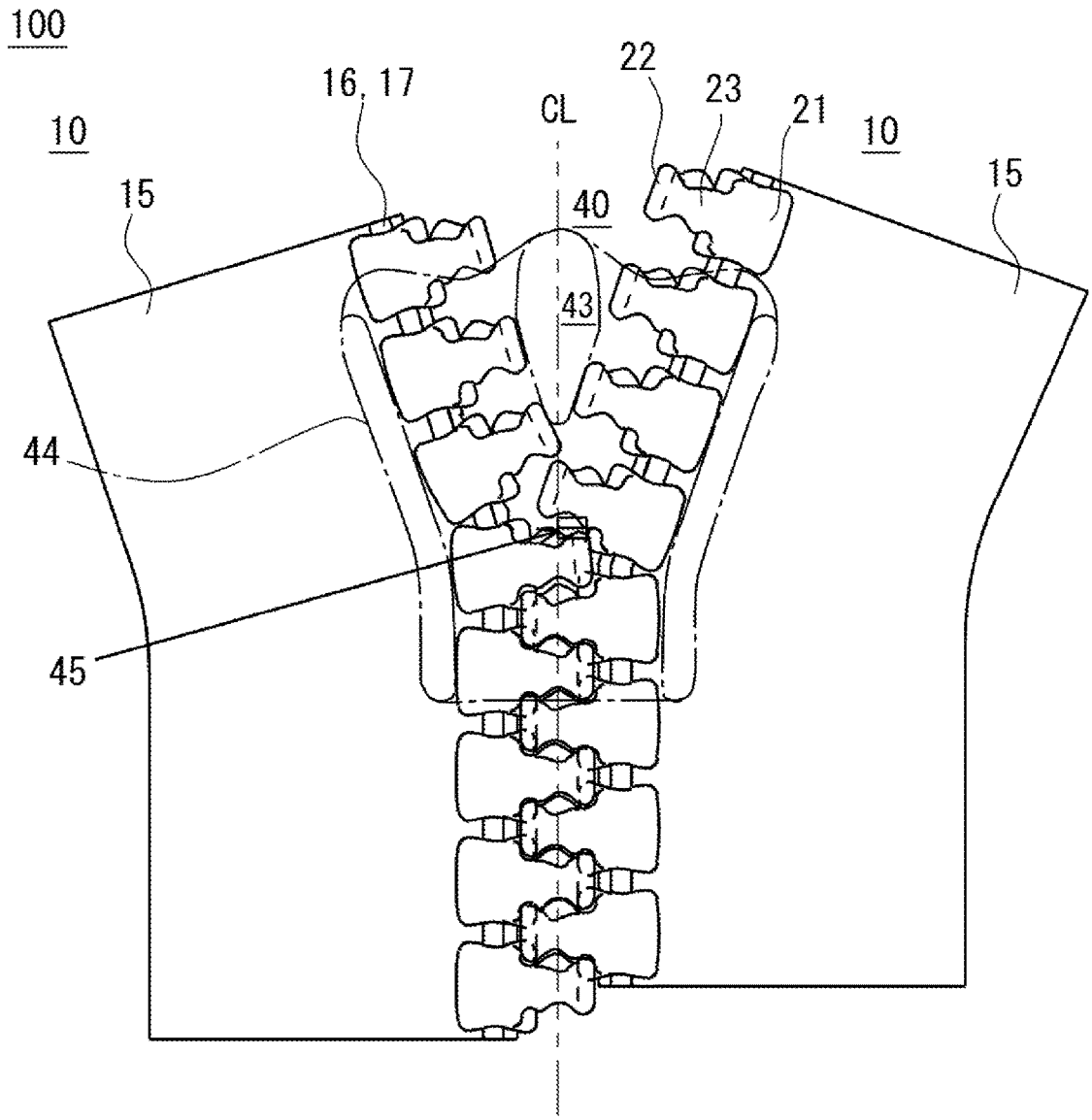

[Fig. 11]
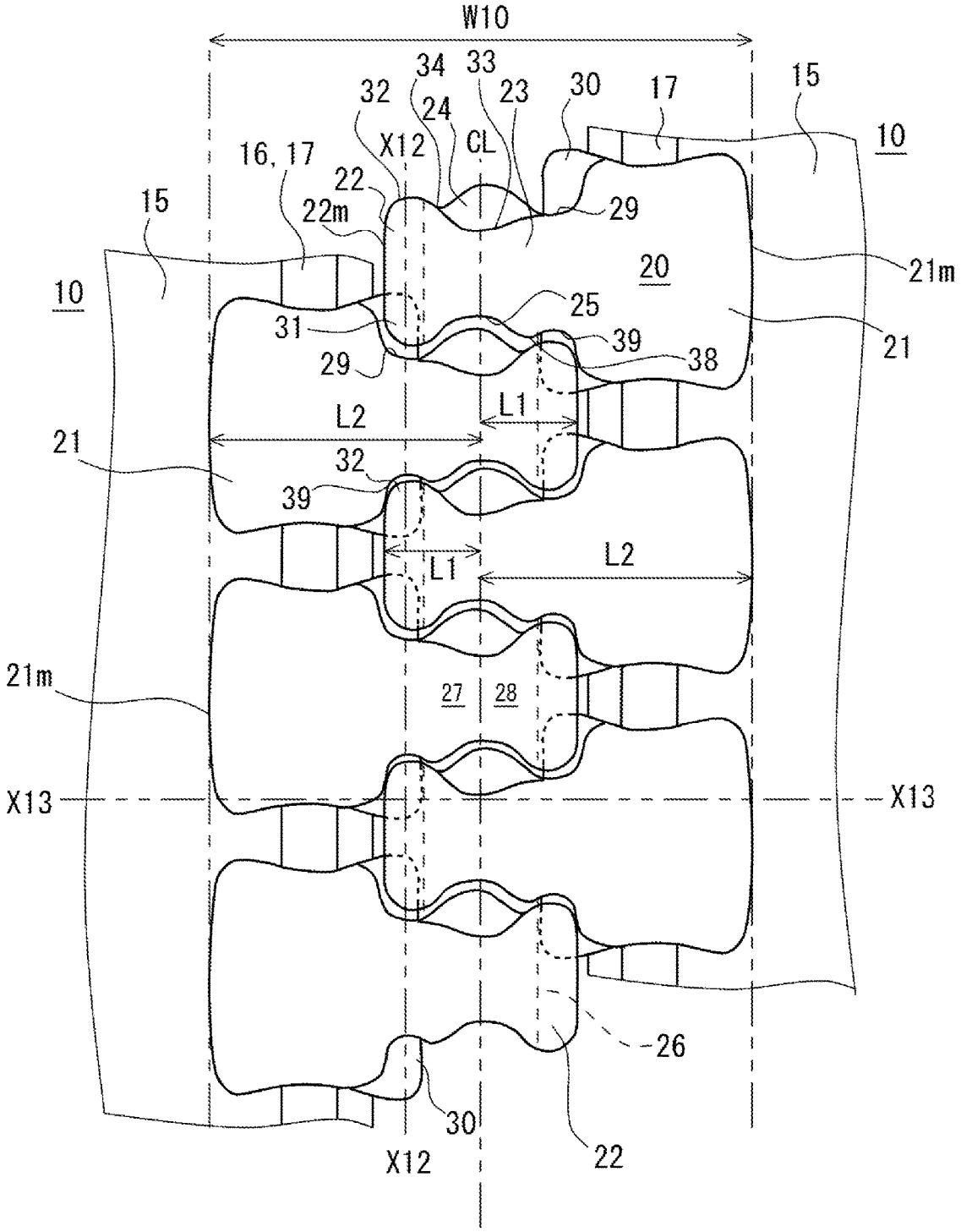

[Fig. 12]
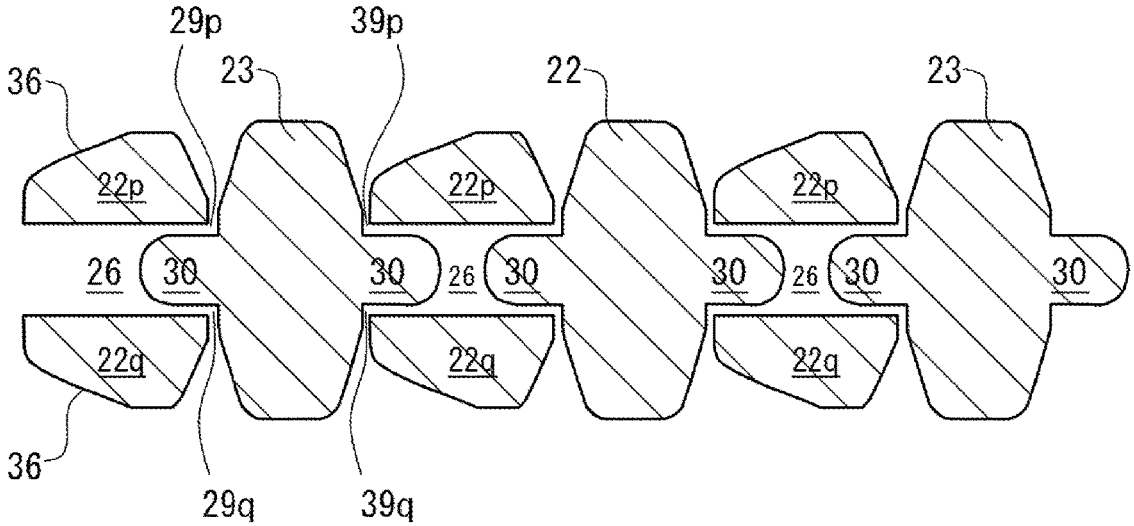
[Fig. 13]
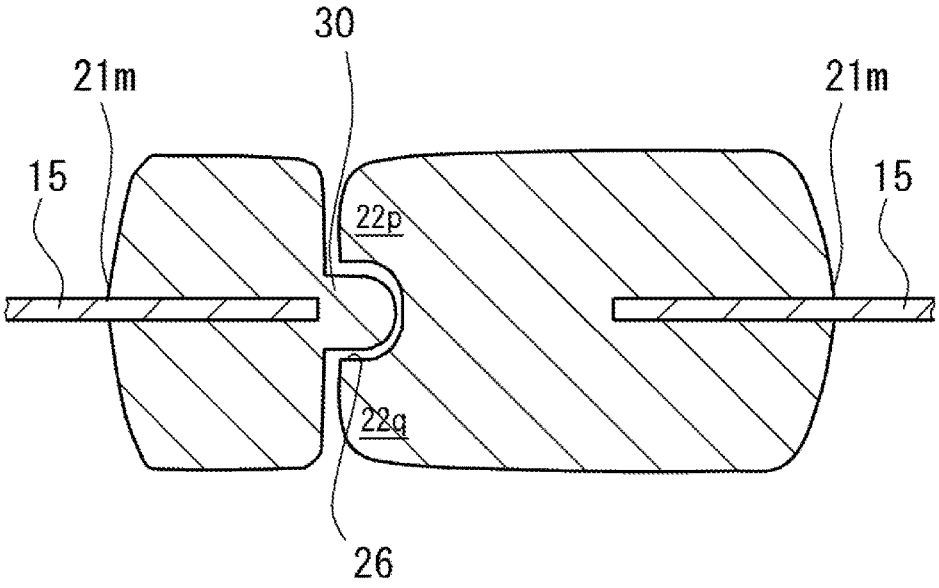

[Fig. 14]
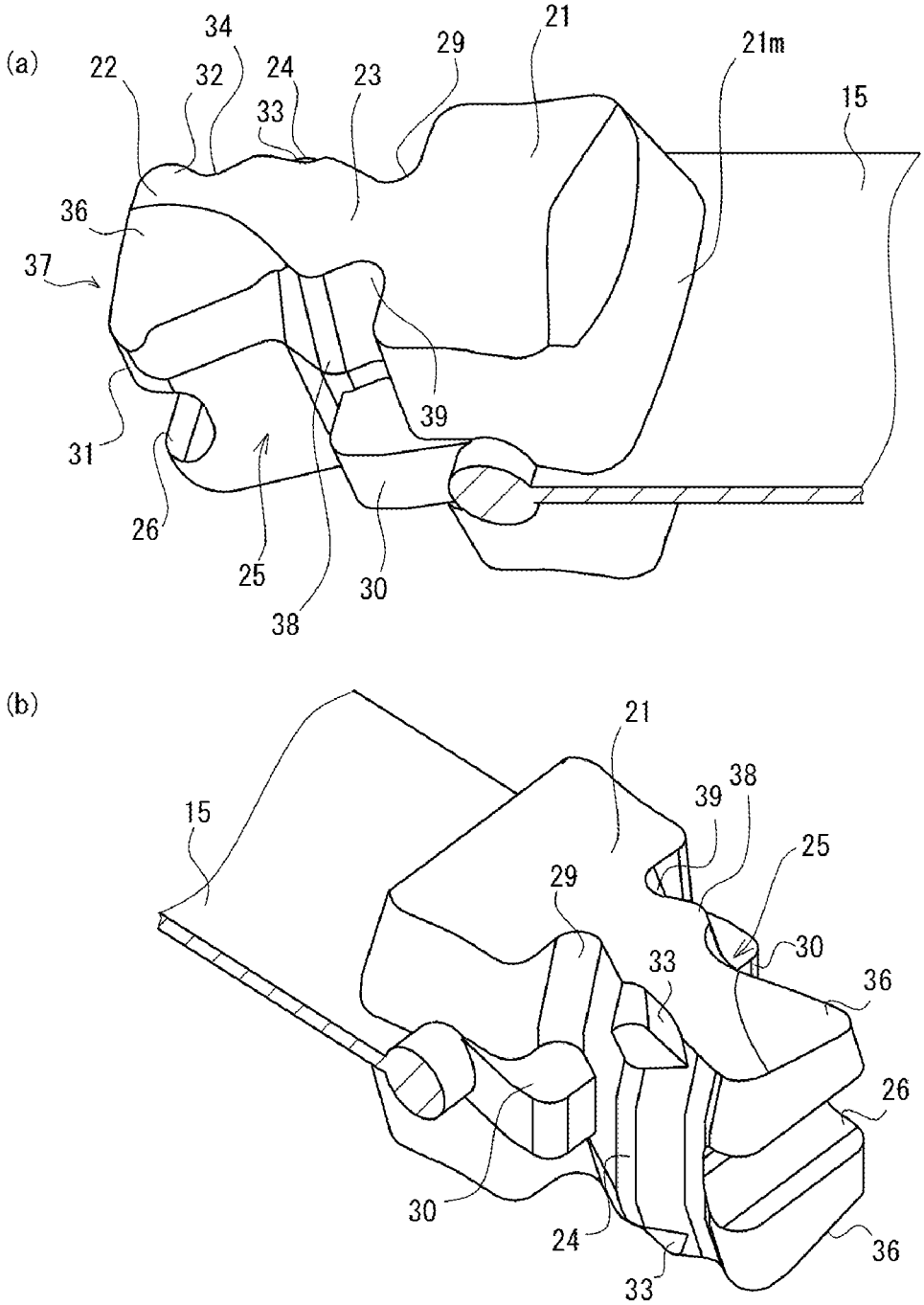

[Fig. 15]
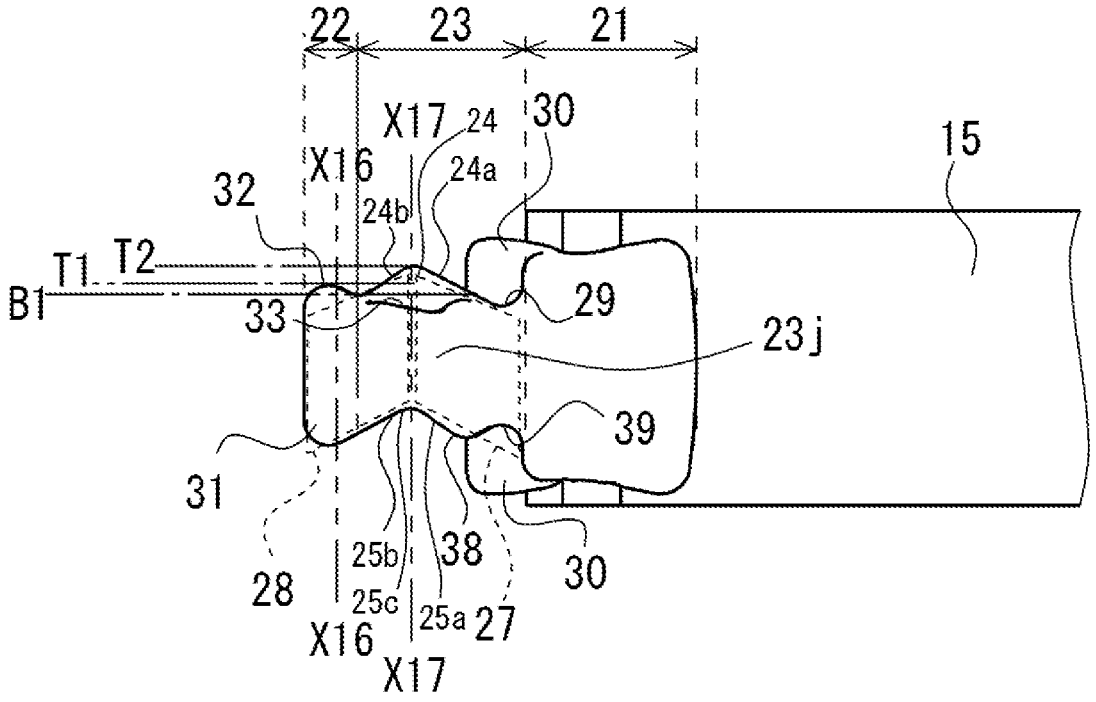

[Fig. 16]
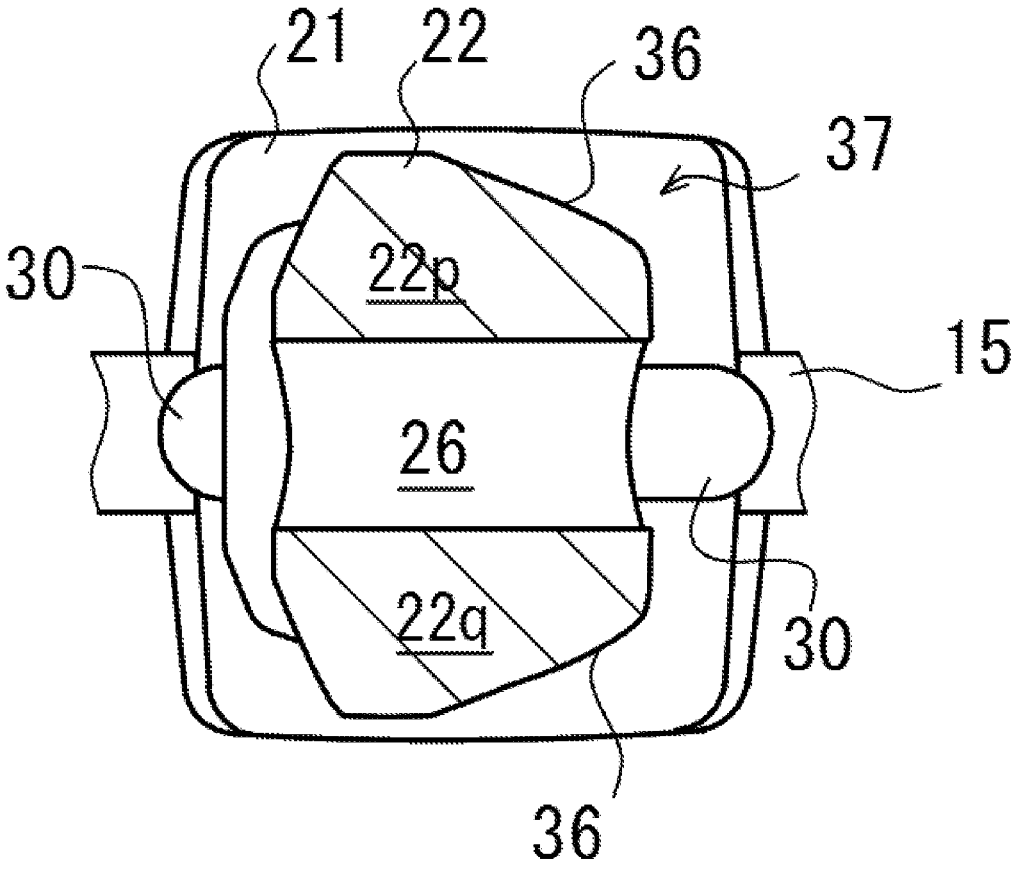

[Fig. 17]
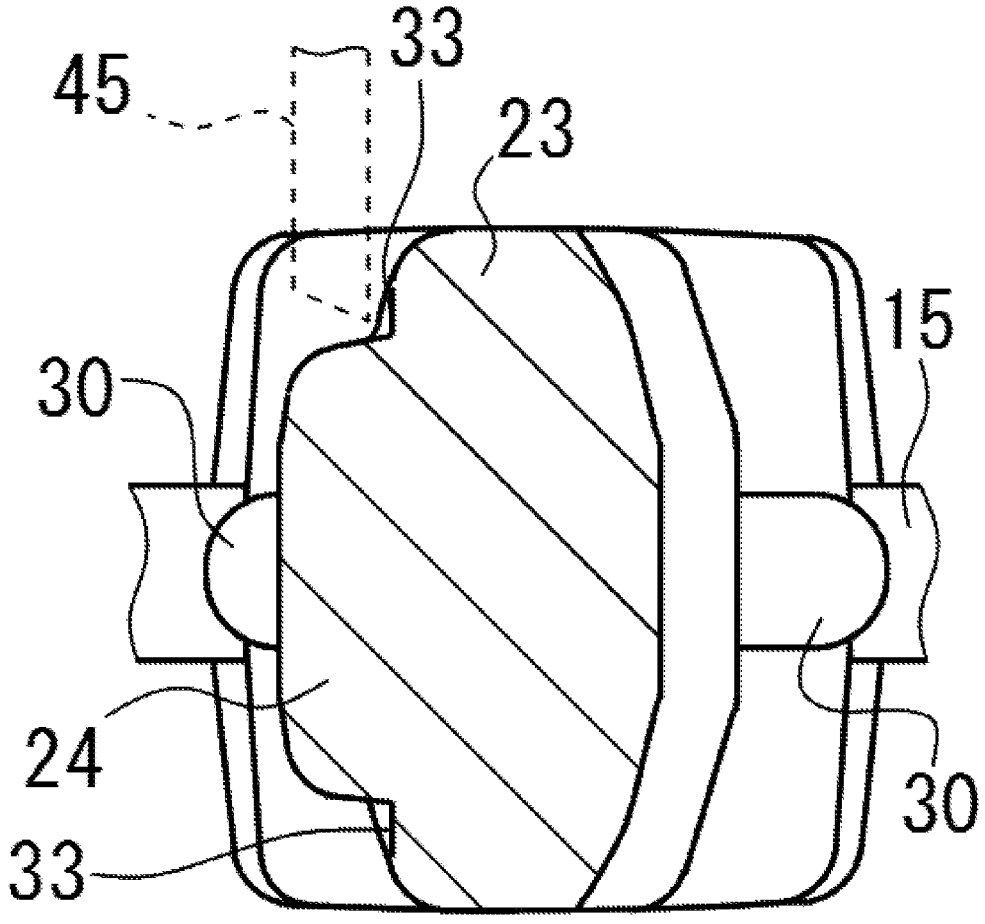

[Fig. 18]
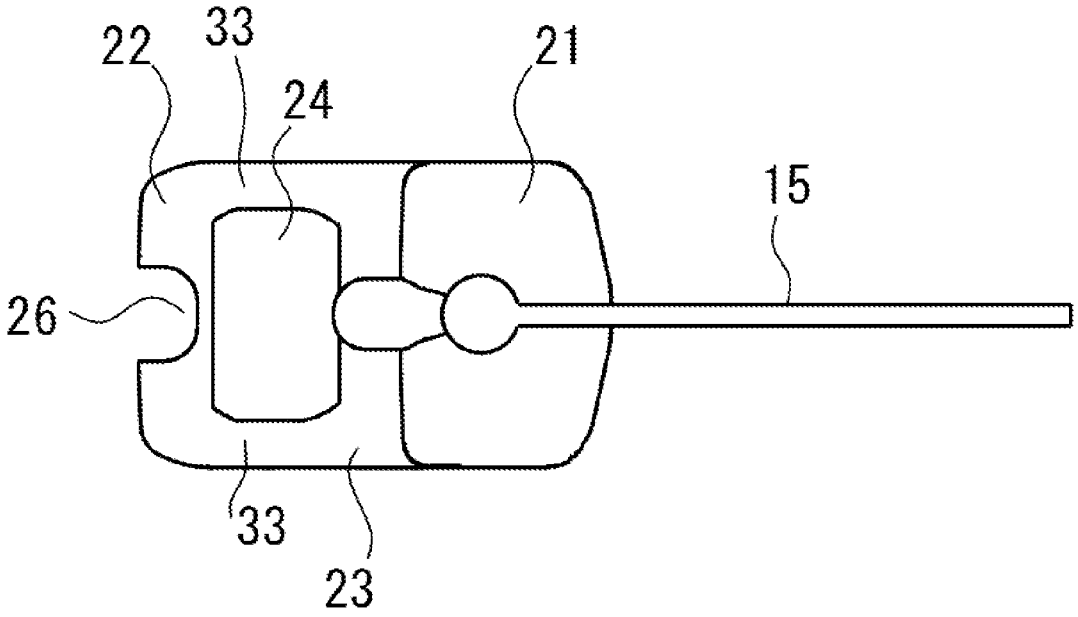
[Fig. 19]
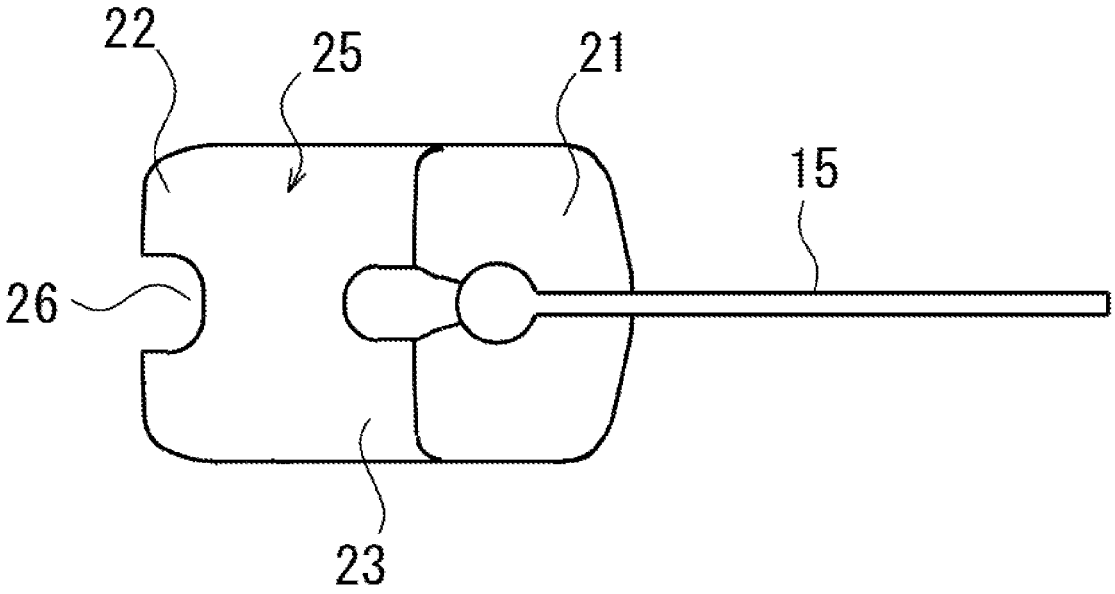

[Fig. 20]
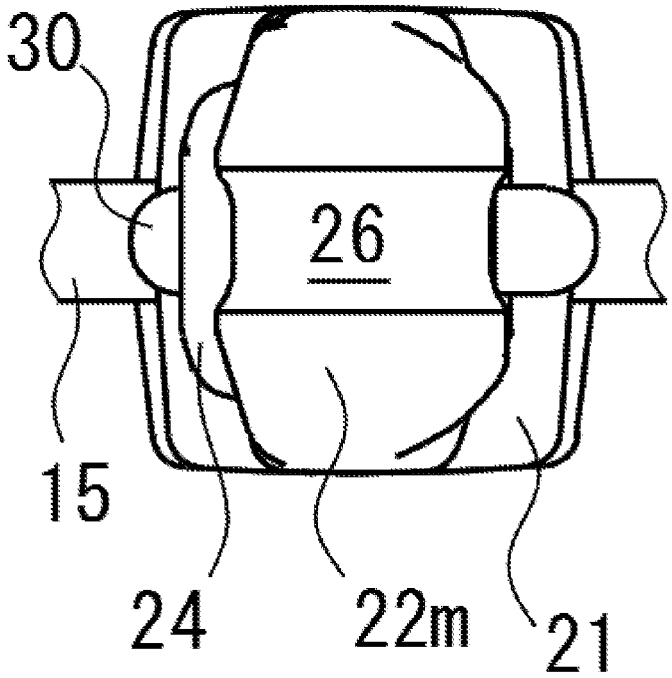

[Fig. 21]
(a)
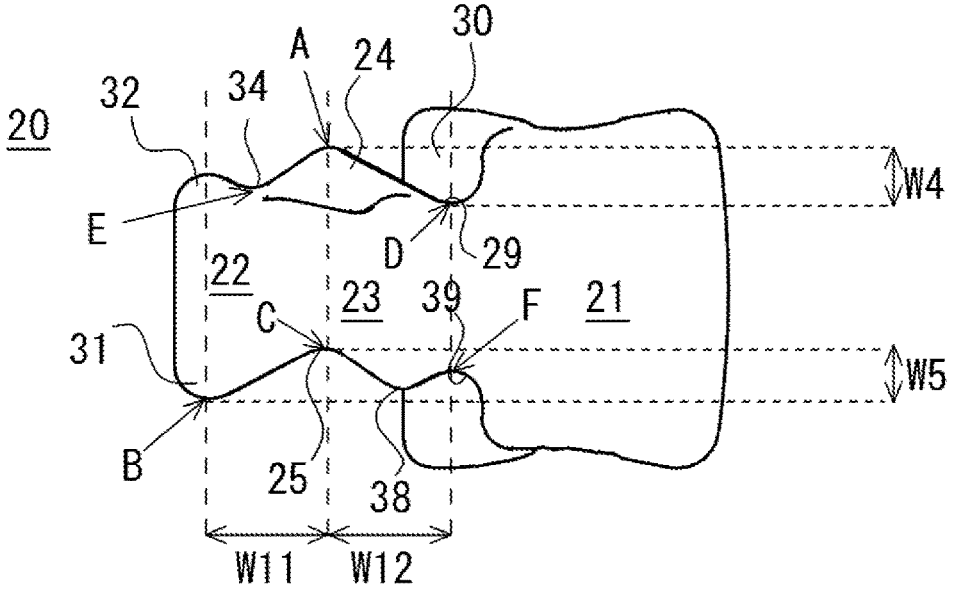
(b)
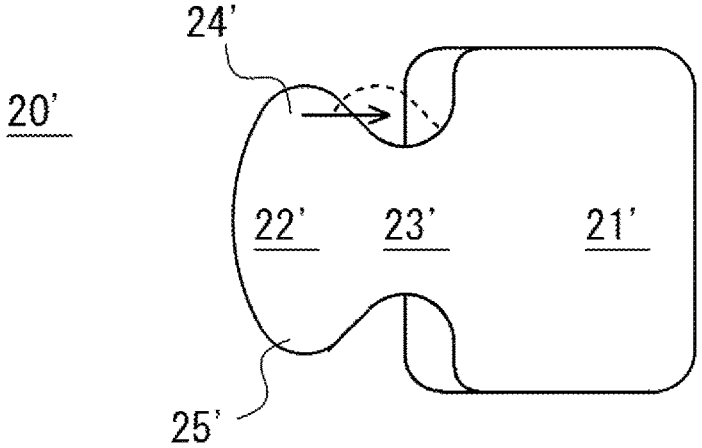

[Fig. 22]
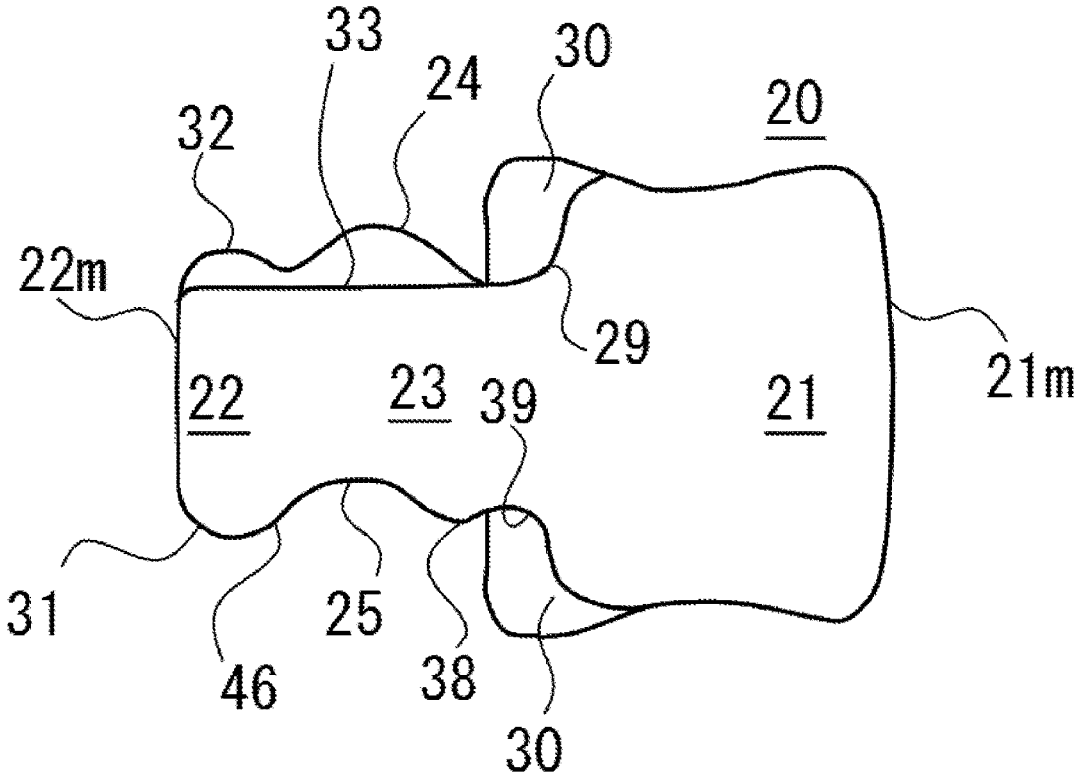

[Fig. 23]
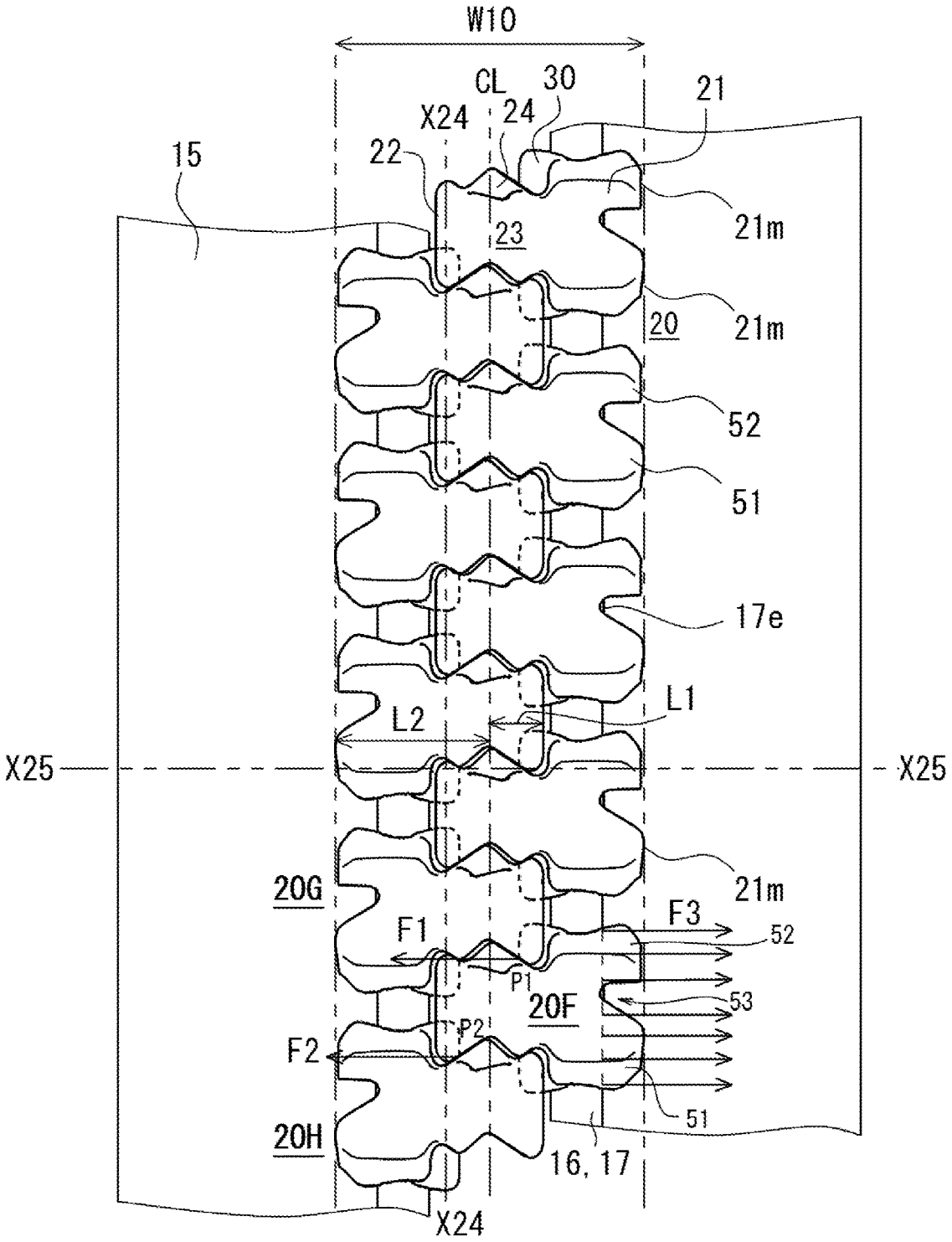

[Fig. 24]
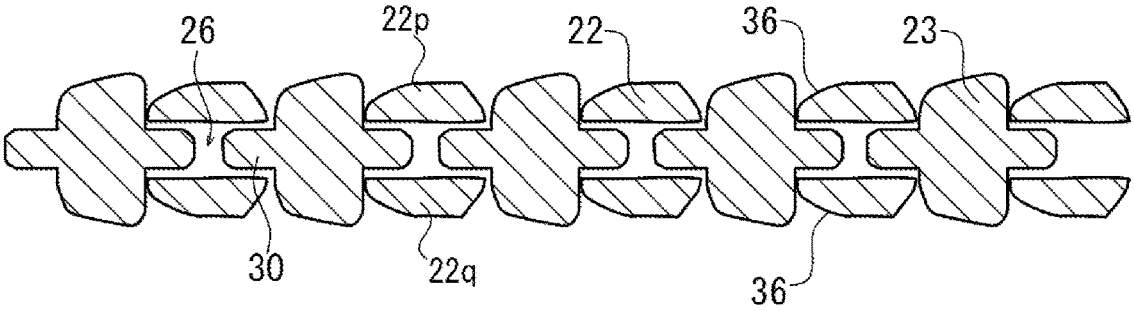
[Fig. 25]
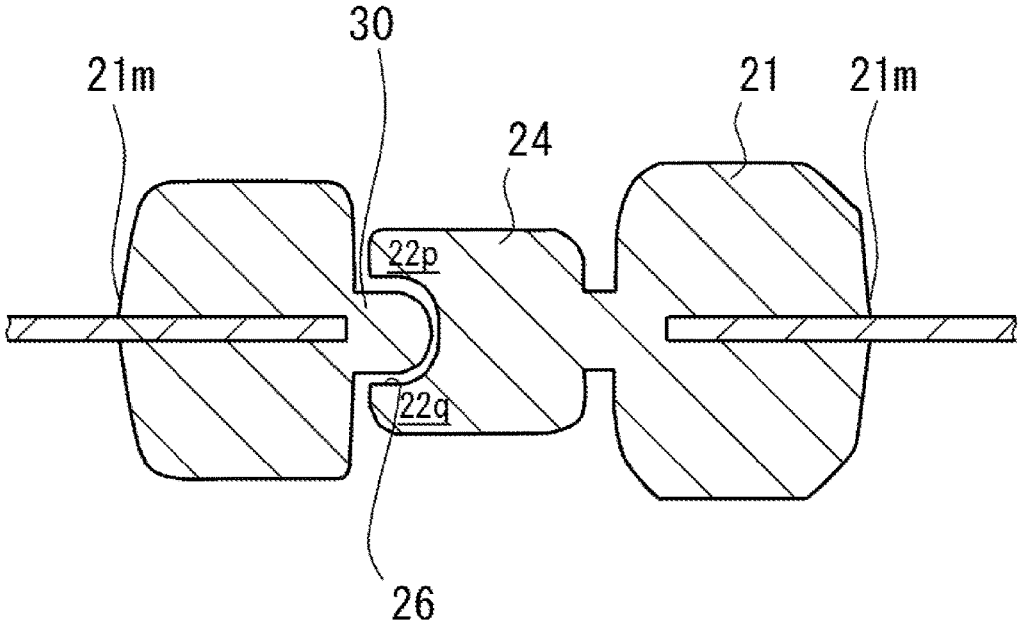

[Fig. 26]
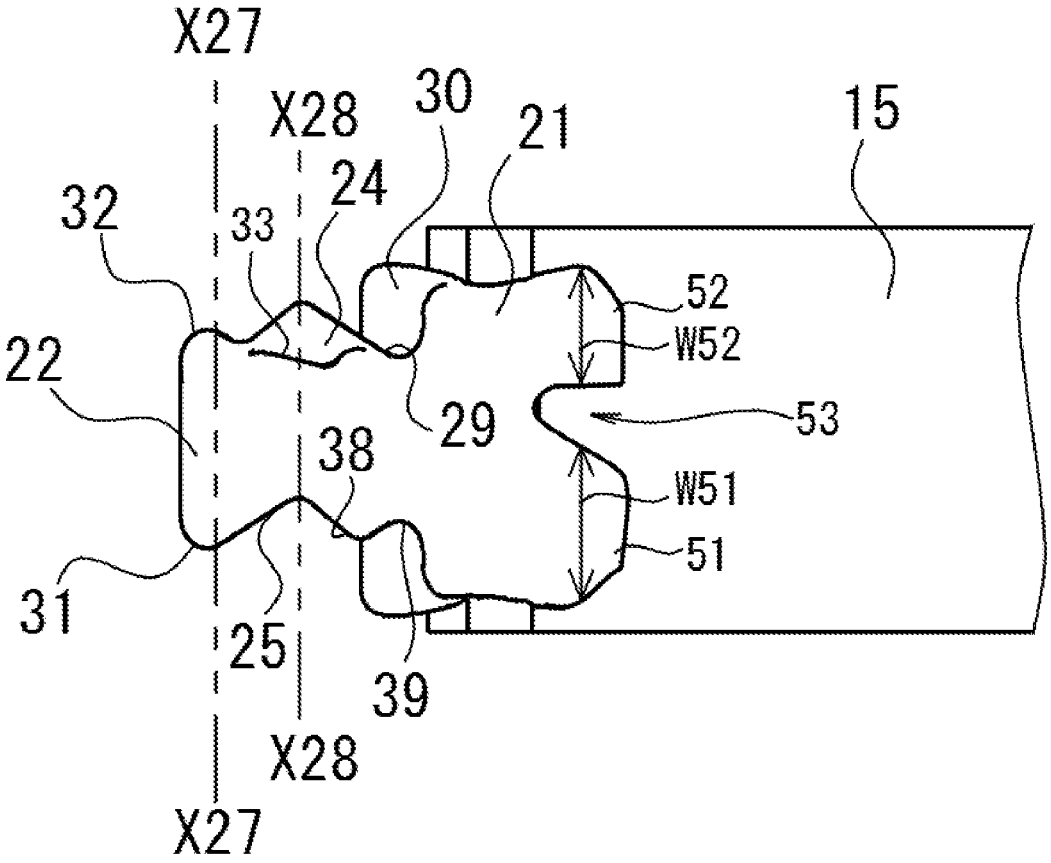

[Fig. 27]
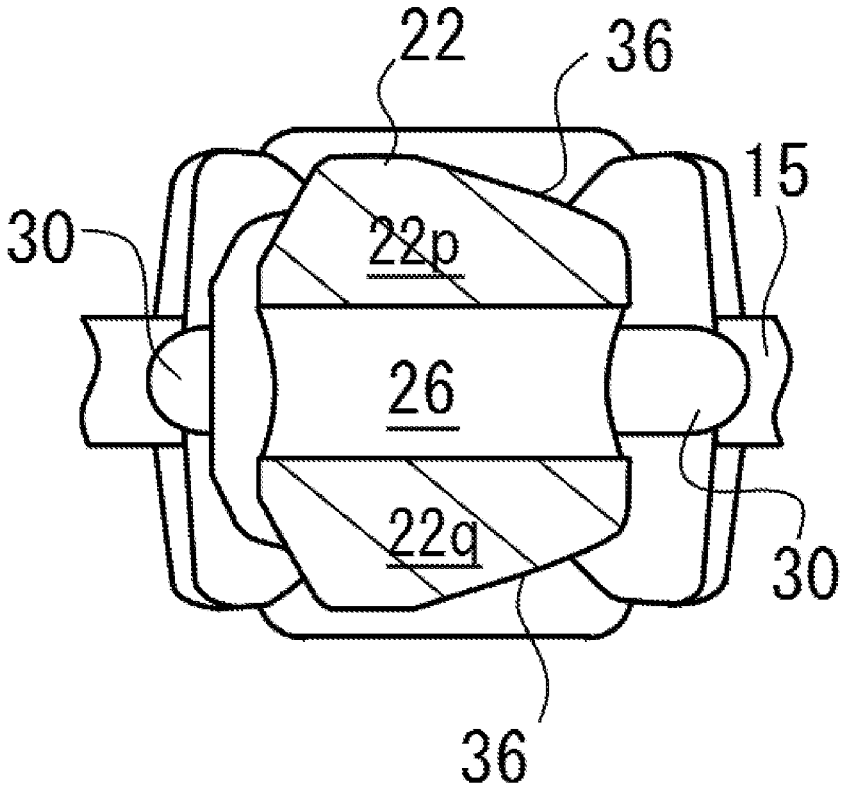

[Fig. 28]
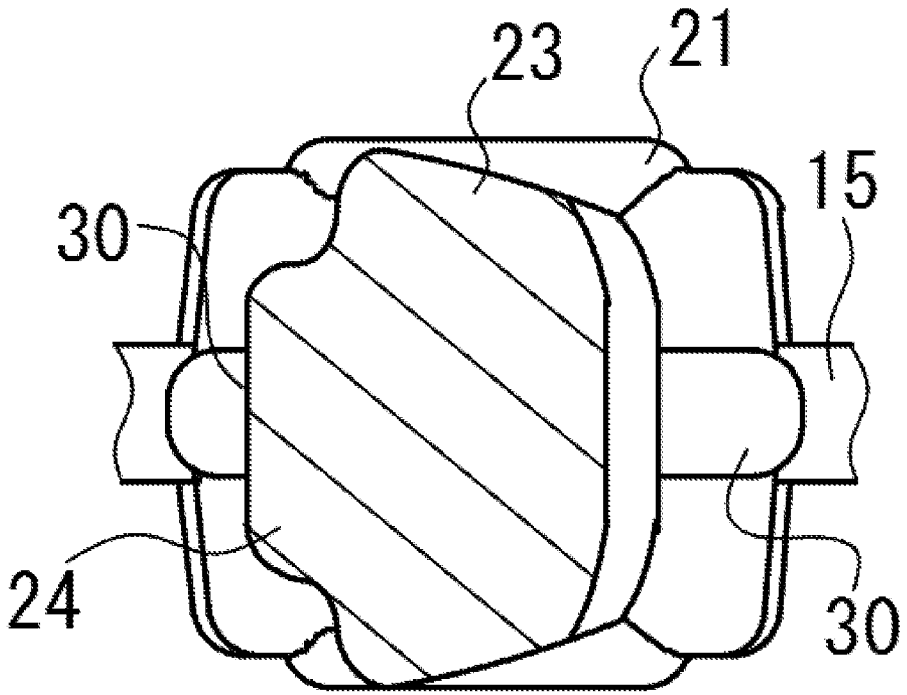

[Fig. 29]
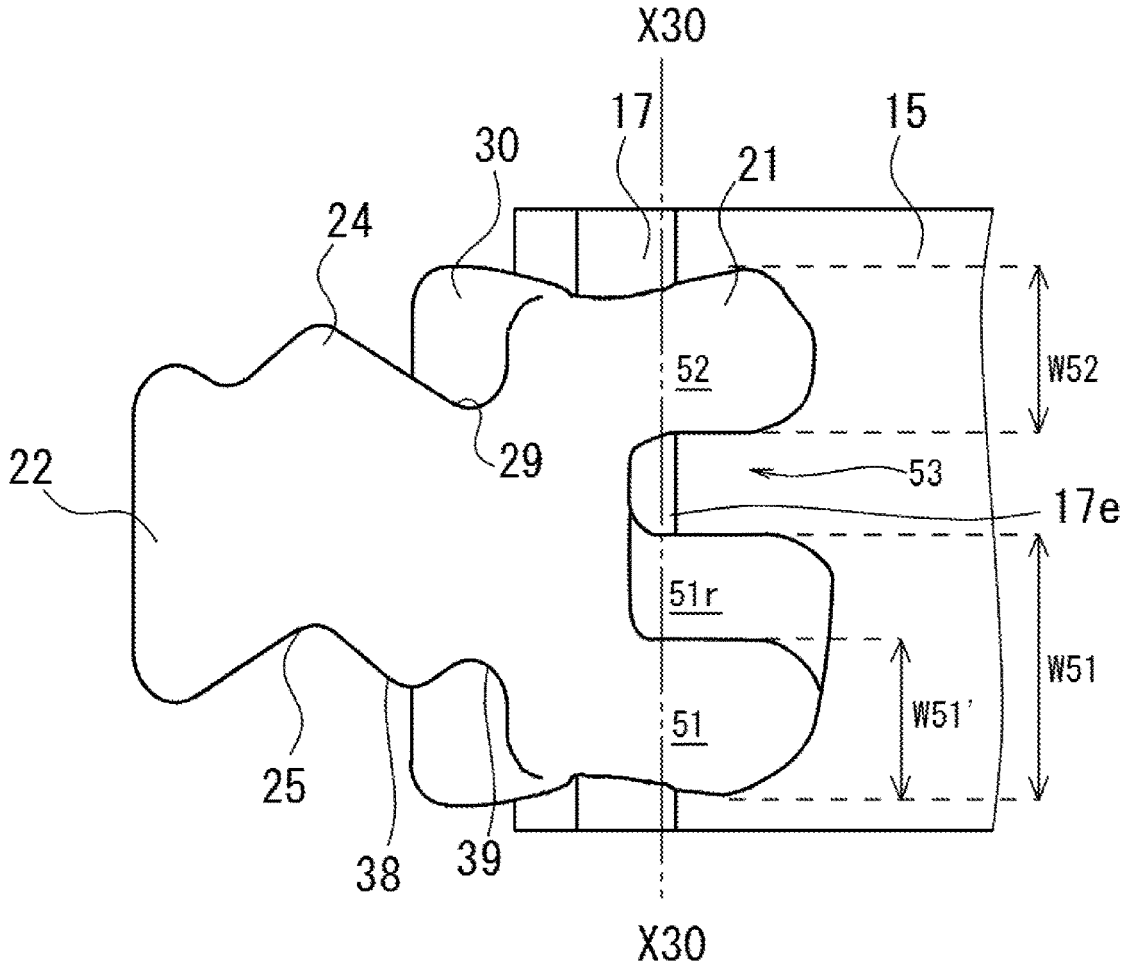

[Fig. 30]
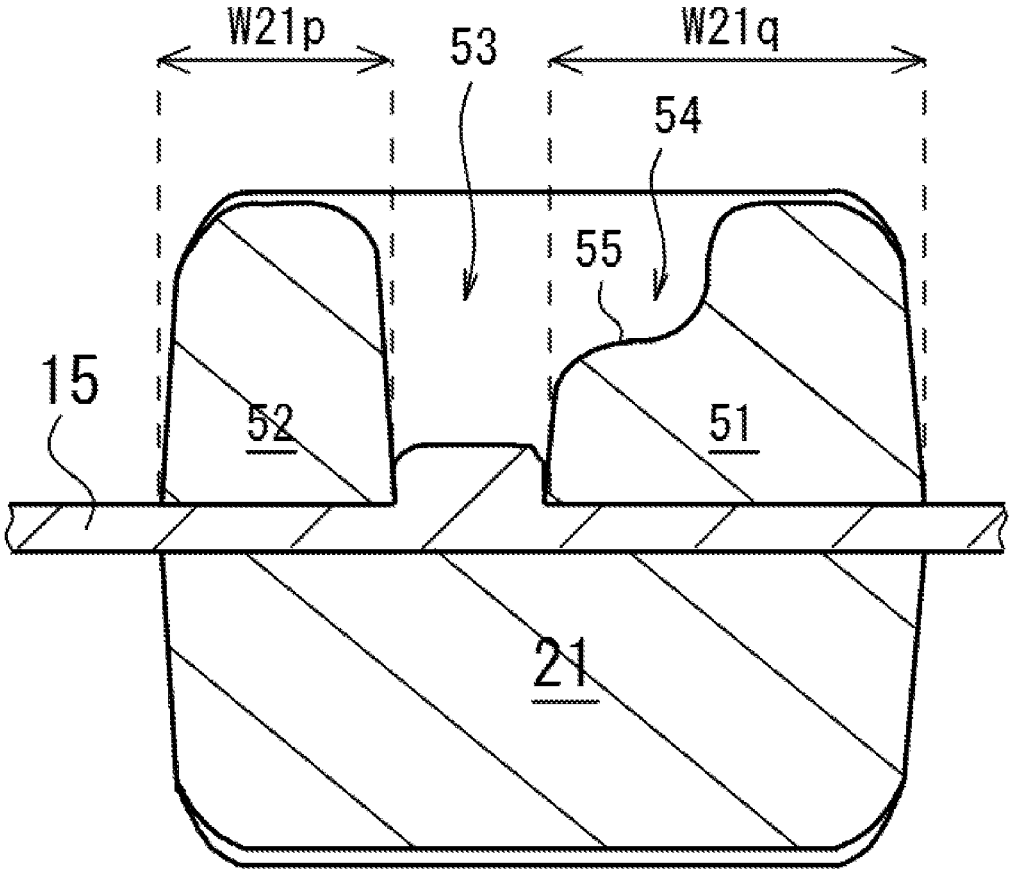

[Fig. 31]
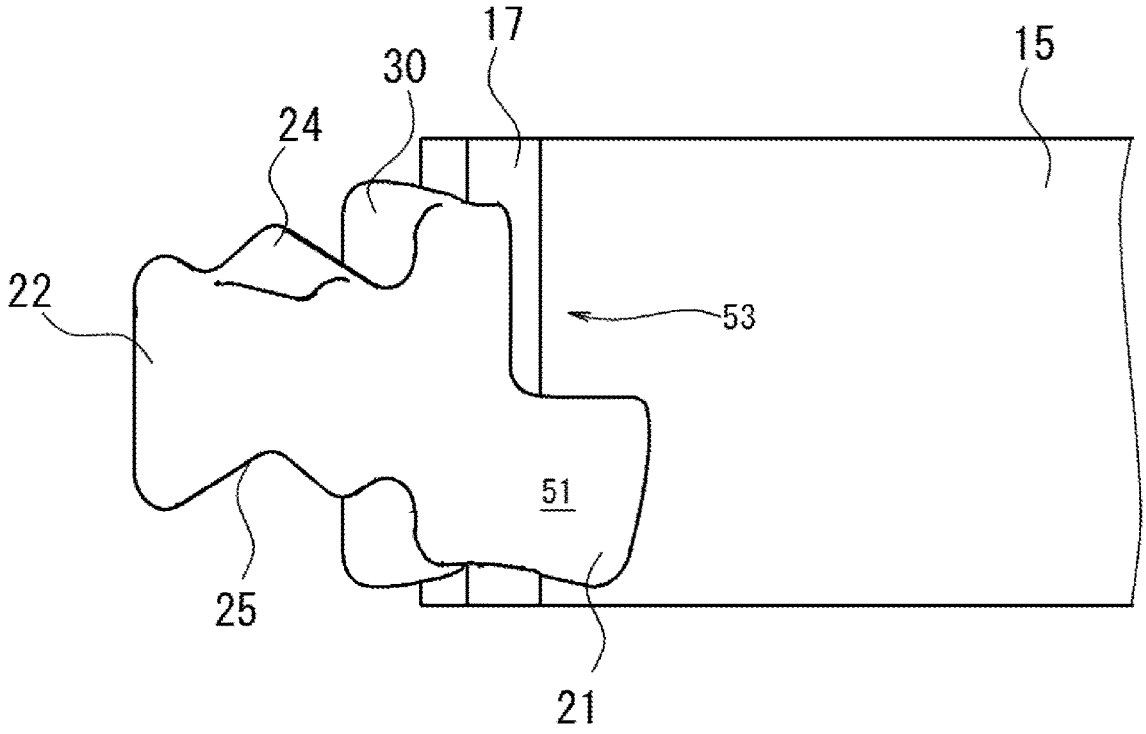

[Fig. 32]
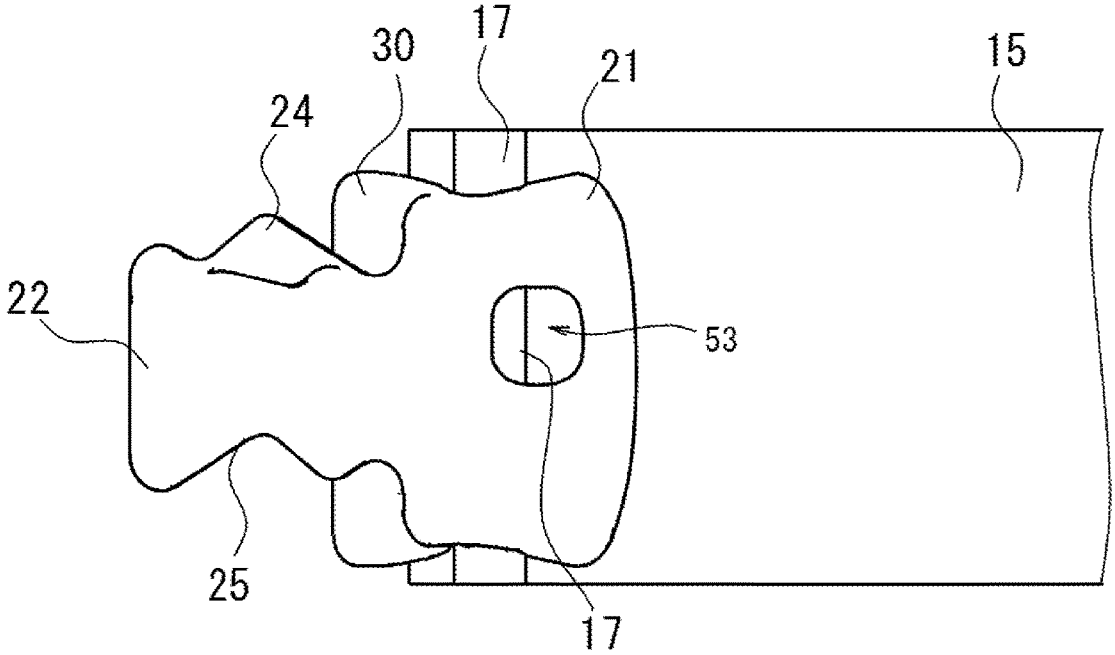

[Fig. 33]
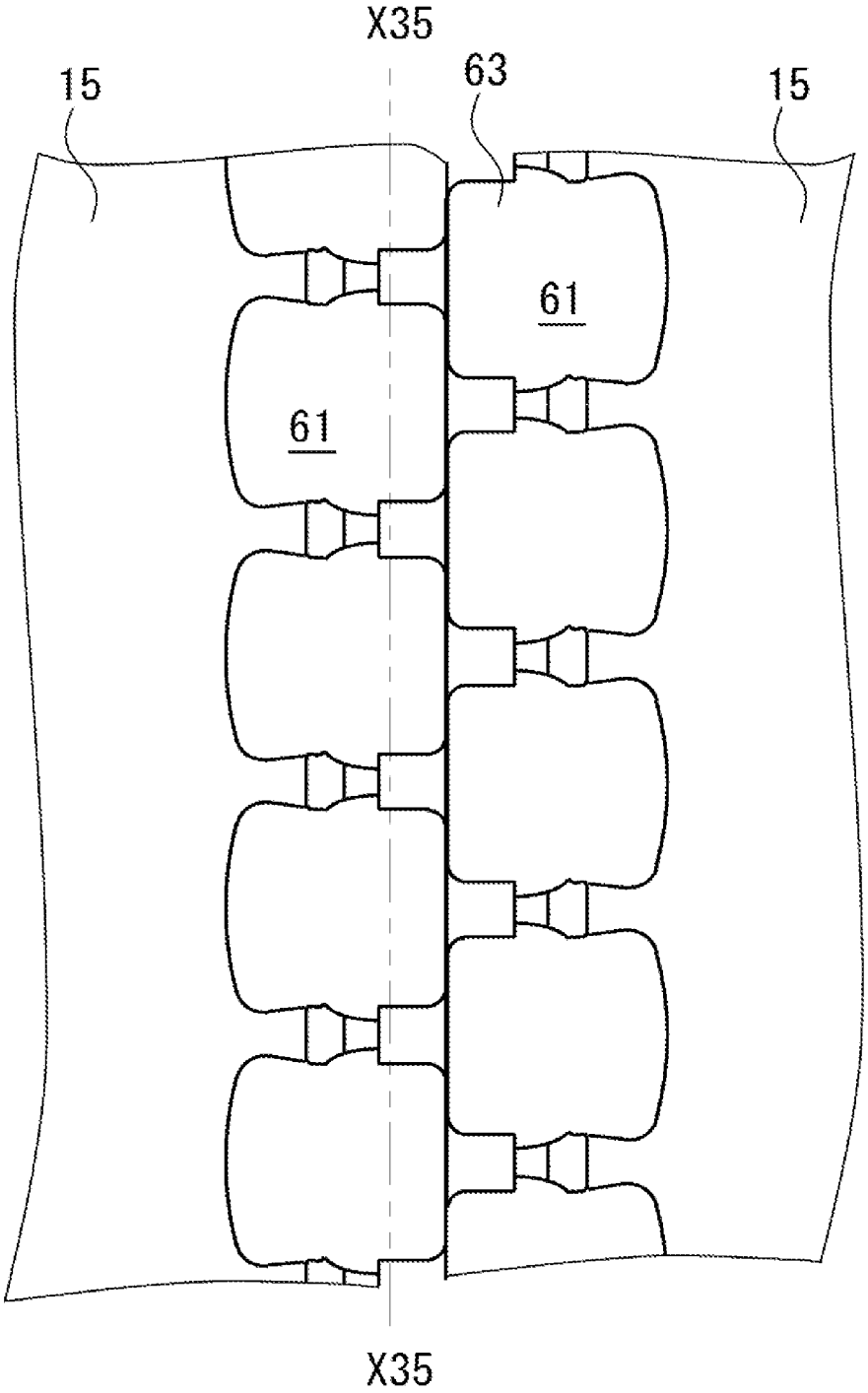

[Fig. 34]
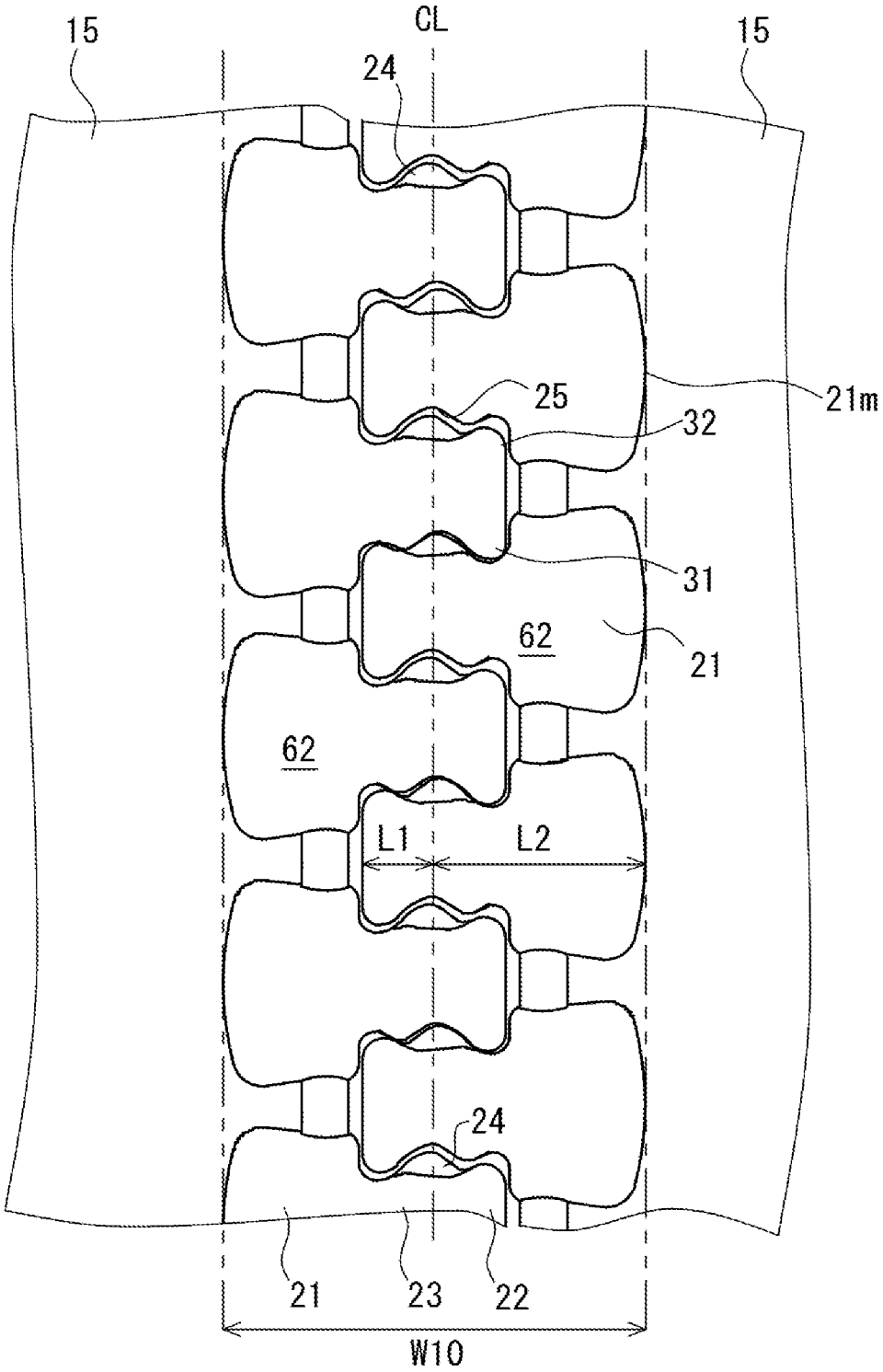

[Fig. 35]
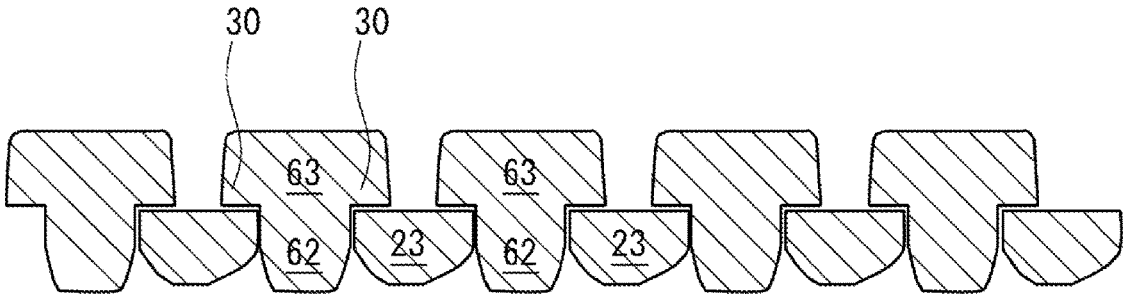
[Fig. 36]
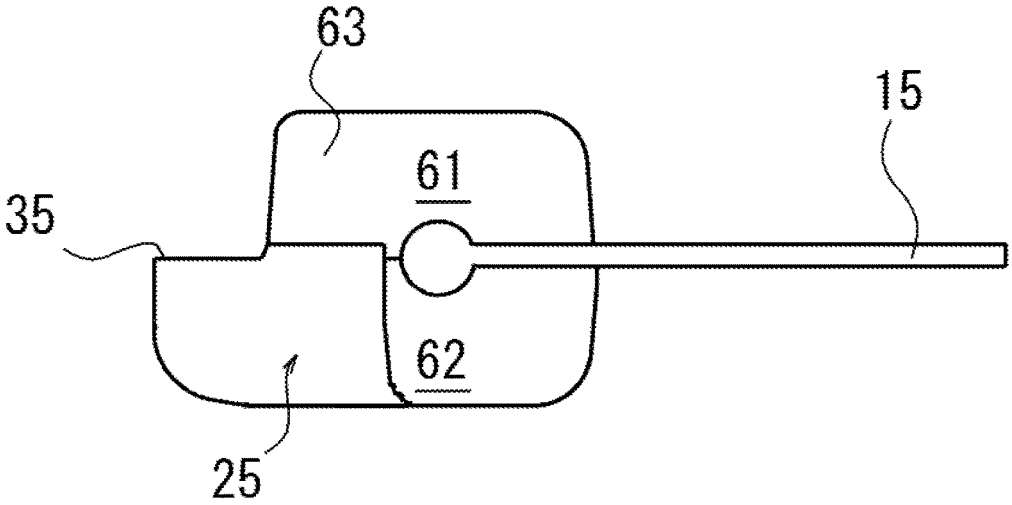

[Fig. 37]
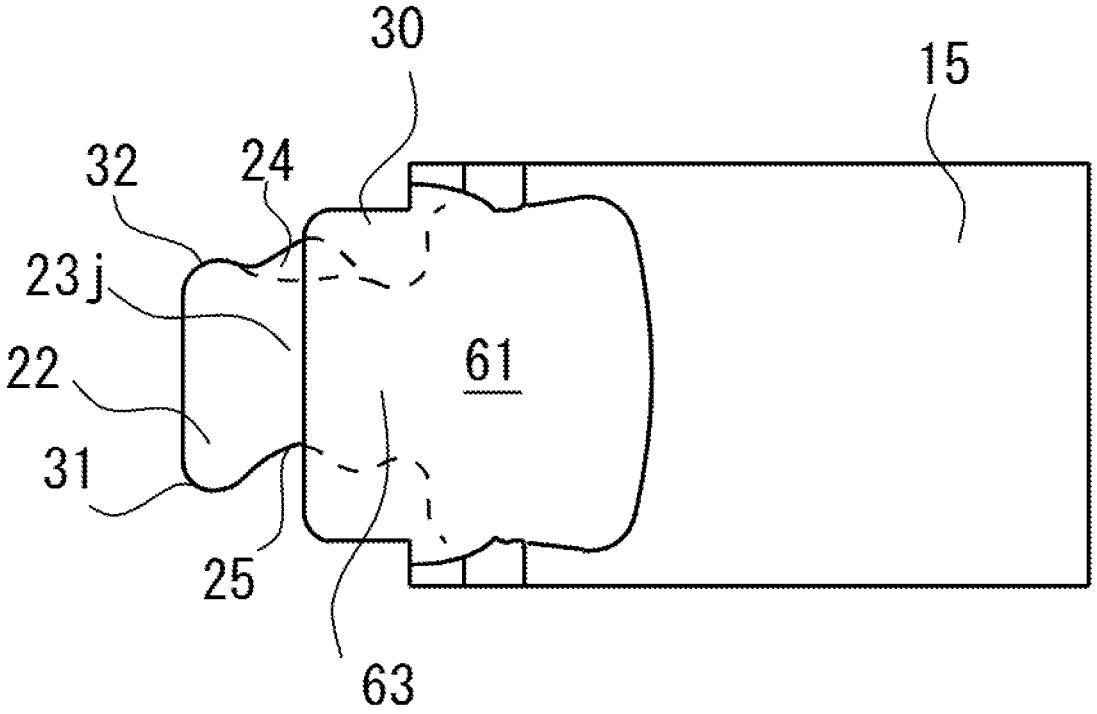

[Fig. 38]
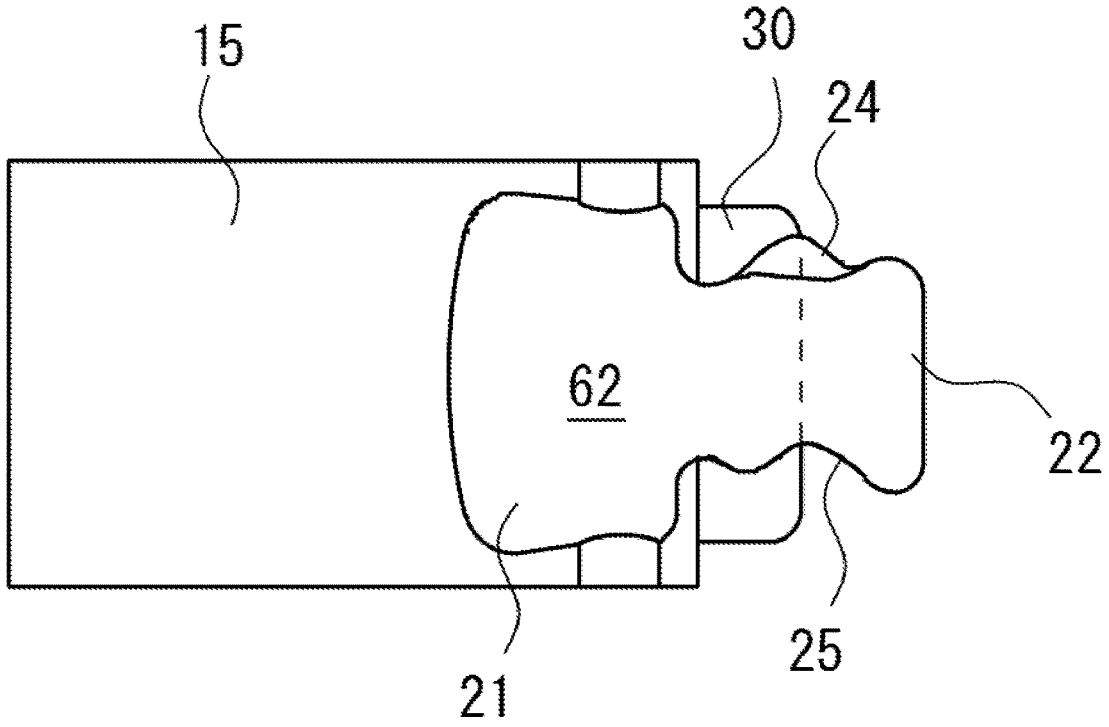

SLIDE FASTENER

CROSS-REFERENCE TO RELATED APPLICATIONS

This application is a U.S. National Stage entry of PCT Application No: PCT/JP2018/019194 filed May 17, 2018, which claims priority to PCT Application No. PCT/JP2017/018926, filed May 19, 2017, the contents of which are incorporated herein by reference.

TECHNICAL FIELD

The present disclosure is directed to a slide fastener.

BACKGROUND ART

Patent literature 1 discloses a technology that provides a slide fastener with narrower width. Left and right fastener elements are coupled alternately along a movement direction of a slider. The length of each fastener element is less than a width, in the left-right direction, of the alternately coupled left and right fastener elements. The shape of each fastener element includes a bent or curved shape.

CITATION LIST

Patent Literature

[PLT 1] U.K. Patent Application Laid-open No. 442809

DESCRIPTION

SUMMARY

Technical Problem

In a conventional slide fastener shown in FIG. 9 of the present application, when a slider is pulled for coupling the left and right fastener elements 500, a head 510 of left fastener element 500 is required to enter into an interspace between heads 510 of right fastener elements arranged adjacently in the right fastener tape. Likewise, a head 510 of right fastener element 500 is required to enter into an interspace between heads 510 of left fastener elements arranged adjacently in the left fastener tape. Force required for this movement of slider causing engagements of fastener elements 20 may be hardly small for physically-weak people such as infant or aged people.

The present inventors have newly recognized a value of supplying a slide fastener which allows reduced force for moving a slider for coupling fastener elements.

Solution to Problem

A slide fastener according to some aspects of the present disclosure may be a slide fastener that includes: a pair of fastener stringers wherein each fastener stringer includes a fastener tape and a plurality of fastener elements attached to the fastener tape, each fastener element including a base portion secured to the fastener tape and a terminal portion positioned opposite to the base portion; and at least one slider for opening and closing the pair of fastener stringers, the slider including an upper wing, a lower wing, a coupling pillar and a flange, the coupling pillar coupling the upper wing and the lower wing, the coupling pillar being opposed to or touched by a terminal surface of the terminal portion of the fastener element, the flange being provided at least one of the upper wing and the lower wing, and the flange being opposed to or touched by a base end surface of the base portion of the fastener element, wherein the fastener element has an intermediate portion including bent or curved portion between the terminal portion and the base portion, the intermediate portion has an engaging protrusion and an engaged recess which are respectively protruded and recessed on an axis that matches a movement direction of the slider, and in an orthogonal direction orthogonal to the axis, a first distance between the axis and the terminal surface of the terminal portion is less than a second distance between the axis and the base end surface of the base portion.

A slide fastener according to some aspects of the present disclosure may be a slide fastener in which the paired fastener stringers are closed by frontward movement of a slider and are opened by rearward movement of the slider, the front-rear direction being identical to the movement direction of the slider along the axis, wherein the fastener element has a first recess that is recessed at an opposite side of the engaged recess and at a same side as the engaging protrusion, and wherein an interspace between a vertex position of the engaging protrusion and a bottom position of the first recess in the front-rear direction is substantially same as an interspace between a rearmost point of the terminal portion and a bottom position of the engaged recess in the front-rear direction.

A slide fastener according to some aspects of the present disclosure may be a slide fastener that includes: a pair of left and right fastener stringers wherein each fastener stringer includes a fastener tape and a plurality of fastener elements attached to the fastener tape, each fastener element including a base portion secured to the fastener tape and a terminal portion positioned opposite to the base portion; and at least one slider that moves frontward to close the pair of left and right fastener stringers and moves rearward to open the pair of left and right fastener stringers, wherein each of the left and right fastener elements is bent or curved so as to have an engaging protrusion at a front side of the fastener element and an engaged recess at a rear side of the fastener element, the fastener element at one side of the left and right sides is provided with a first recess between the engaging protrusion and the base portion, the first recess being configured to receive a first protuberance that is protruded rearward and is provided on the fastener element at the other side of the left and right sides, and in the respective left and right fastener elements, the engaging protrusion is provided at a position shifted closer to the base portion than the first protuberance in a left-right direction, and the first recess is positioned at a position shifter closer to the base portion than the engaged recess in the left-right direction.

A slide fastener according to some aspects of the present disclosure may be a slide fastener that includes: a pair of left and right fastener stringers wherein each fastener stringer includes a fastener tape and a plurality of fastener elements attached to the fastener tape, each fastener element including a base portion secured to the fastener tape and a terminal portion positioned opposite to the base portion; and at least one slider for opening and closing the pair of left and right fastener stringers, wherein each of the fastener elements at the left and right sides has an intermediate portion including bent or curved portion between the terminal portion and the base portion, the intermediate portion has an engaging protrusion and an engaged recess which are respectively protruded and recessed on an axis that matches a movement direction of the slider, and the fastener element at one side of the left and right sides has at least one displacement-restricting portion that prevents displacement, along an up-down direction, of the fastener element at the other side of the left and right sides.

Advantageous Effects of Invention

According to an aspect of the present disclosure, a slide fastener may be provided which allows reduced force for moving a slider for coupling fastener elements.

BRIEF DESCRIPTION OF DRAWINGS

FIG. 1 is a schematic and partial elevational view of a slide fastener according to an aspect of the present disclosure, coupling pillar and flanges of slider are shown in cross-section and a contour of upper and lower wings of a slider is shown by dotted line.

FIG. 2 is a schematic and partial elevational view of fastener stringer of a slide fastener according to an aspect of the present disclosure.

FIG. 3 is a schematic cross-sectional view taken along a line in FIG. 1.

FIG. 4 is a schematic side view of a fastener element showing a terminal surface of a terminal portion of a fastener element.

FIG. 5 is a reference view for describing a process how left and right fastener elements are coupled.

FIG. 6 is a reference view for describing a process how left and right fastener elements are coupled.

FIG. 7 is a reference view for describing a process how left and right fastener elements are coupled.

FIG. 8 is a reference view for describing a process how left and right fastener elements are coupled.

FIG. 9 is a schematic and partial elevational view of conventional slide fastener, showing coupled fastener elements.

FIG. 10 is a schematic and partial elevational view of a slide fastener according to an aspect of the present disclosure where a slider is schematically illustrated by dash-dot line.

FIG. 11 is a schematic and partial elevational view showing coupled left and right fastener stringers.

FIG. 12 is a schematic end view taken along a two-dot chain line X12-X12 in FIG. 11.

FIG. 13 is a schematic end view taken along a two-dot chain line X13-X13 in FIG. 11.

FIGS. 14(*a*) and 14(*b*), which may be collectively referred to as FIG. 14, are schematic perspective views of a fastener element fixed to a fastener tape.

FIG. 15 is a schematic elevational view of a fastener element fixed to a fastener tape.

FIG. 16 is a schematic end view taken along a two-dot chain line X16-X16 in FIG. 15, showing a sloped surface provided on a terminal portion of fastener element.

FIG. 17 is a schematic end view taken along a two-dot chain line X17-X17 in FIG. 15, showing a locking wall provided on a fastener element.

FIG. 18 is a schematic front view of a fastener element fixed to a fastener tape.

FIG. 19 is a schematic rear view of a fastener element fixed to a fastener tape.

FIG. 20 is a schematic side view of a fastener element fixed to a fastener tape, showing a terminal surface of a terminal portion of fastener element.

FIG. 21(*a*) shows a fastener element according to the present disclosure, and FIG. 21(*b*) shows a conventional fastener element.

FIG. 22 is a schematic elevational view of a fastener element where a locking wall by which a locking pawl of slider can be locked extends up to a terminal surface of a terminal portion of fastener element.

FIG. 23 is a schematic and partial elevational view showing coupled left and right fastener stringers of a slide fastener according to an aspect of the present disclosure, a base portion of fastener element having first and second legs.

FIG. 24 is a schematic end view taken along a two-dot chain line X24-X24 in FIG. 23.

FIG. 25 is a schematic end view taken along a two-dot chain line X25-X25 in FIG. 23.

FIG. 26 is a schematic elevational view of a fastener element fixed to a fastener tape.

FIG. 27 is a schematic end view taken along a two-dot chain line X27-X27 in FIG. 26.

FIG. 28 is a schematic end view taken along a two-dot chain line X28-X28 in FIG. 26.

FIG. 29 is a schematic elevational view of a fastener element of a slide fastener according to an aspect of the present disclosure where width of first leg of base portion of fastener element appears to have a narrower width.

FIG. 30 is a schematic end view taken along a two-dot chain line X30-X30 in FIG. 29.

FIG. 31 is a schematic elevational view of a fastener element of a slide fastener according to an aspect of the present disclosure where a second leg is removed.

FIG. 32 is a schematic elevational view of a fastener element of a slide fastener according to an aspect of the present disclosure where a base portion is provided with a hole.

FIG. 33 is a schematic and partial top view showing coupled left and right fastener stringers of a slide fastener according to an aspect of the present disclosure.

FIG. 34 is a schematic and partial bottom view showing coupled left and right fastener stringers of a slide fastener according to an aspect of the present disclosure.

FIG. 35 is a schematic end view taken along a two-dot chain line X35-X35 in FIG. 33.

FIG. 36 is a schematic rear view of a fastener element fixed to a fastener tape, showing a recess provided at an intermediate portion of fastener element.

FIG. 37 is a schematic top view of a fastener element fixed to a fastener tape, a lower-side structure is shown by dotted line.

FIG. 38 is a schematic bottom view of a fastener element fixed to a fastener tape, an upper-side structure is shown by dotted line.

DESCRIPTION OF EMBODIMENTS

Hereinafter, non-limiting exemplary embodiments of the present invention will be described with reference to FIGS. 1 to 38. Disclosed one or more exemplary embodiments and respective features included in the exemplary embodiments are not mutually exclusive. A skilled person would be able to combine respective exemplary embodiments and/or respective features without requiring excess descriptions. Also a skilled person would appreciate synergistic effects of such combinations. Overlapping descriptions among the exemplary embodiments would be basically omitted. Referenced drawings are prepared for the purpose of illustration of invention, and may possibly be simplified for the sake of convenience of illustration.

In the following descriptions, plural features described for one slide fastener may be understood as combination of these features, but may be understood as independent features independent from other features. Independent feature may be understood as independent feature without requiring combination with other features, but may be understood as combination with one or more other independent features. Recitation of all combination of independent features is redundant for a skilled person, and thus omitted. An individual feature would be clearly highlighted by a phrase such as "In some cases". The independent feature would be understood as a universal feature effective not only for a slide fastener disclosed in the drawings but also effective for other various slide fasteners.

In the present specification, terms of direction defined as follows will be used. Front-rear direction matches a movement direction of a slider or would be recognized based on a movement direction of a slider. Left-right direction is orthogonal to the front-rear direction in a plan where paired fastener stringers exist. Up-down direction is orthogonal to the front-rear direction and the left-right direction respectively. It should be noted that, these terms can be redefined based on the following descriptions. It should be noted that the front-rear, left-right and up-down directions referred in the present specification and/or Claim do not need to match another standard such as up-down, left-right and front-rear directions recognized based on a vertical direction or a viewer, for example.

As shown in FIG. 1, a slide fastener 100 is provided with a pair of fastener stringers 10 and at least one slider 40 for opening and closing the pair of fastener stringers 10. Envisioned are examples where the slide fastener 100 is provided with two or more sliders. For the sake of description, a fastener tape 15 and a fastener element 20 of the left fastener stringer 10 of the pair may possibly be referred to as a left fastener tape 15 and a left fastener element 20 respectively. Likewise, a fastener tape 15 and a fastener element 20 of the right fastener stringer 10 of the pair may possibly be referred to as a right fastener tape 15 and a right fastener element 20 respectively.

The left and right fastener stringers 10 are closed by frontward movement of the slider 40, and the left and right fastener stringers 10 are opened by rearward movement of the slider 40. Closed left and right fastener stringers 10 results in coupled left and right fastener elements 20. Opened left and right fastener stringers 10 results in decoupled left and right fastener elements 20.

Each fastener stringer 10 included in the paired fastener stringers 10 has a fastener tape 15 and a plurality of fastener elements 20 attached to the fastener tape 15. The fastener tape 15 is a thin flexible member and has upper and lower tape surfaces as a pair of tape surfaces. The fastener tape 15 has a side-edge 16 to which the fastener elements 20 are attached. Core thread 17 may be provided at the side-edge 16 for strengthening the coupling of the fastener tape 15 and the fastener element 20. In some cases, the fastener tape 15 is a woven fabric or knitted fabric or combination thereof. The core thread 17 may be woven together with the fastener tape 15 or sewn to the fastener tape 15.

The fastener element 20 has a base portion 21 secured to the fastener tape 15 and a terminal portion 22 positioned opposite to the base portion 21. The terminal portion 22 is provided outwardly of fastener tape relative to the base portion 21. Outwardly of fastener tape indicates a direction directed from a point over the tape surface of the fastener tape 15 to a point external to the tape surface. The terminal portion 22 of the fastener element 20 provided at one fastener tape 15 is arranged closer to the other fastener tape 15 than the base portion 21 of the fastener element 20. The base portion 21 exists on the tape surface of the fastener tape 15, particularly on the side-edge 16 and the core thread 17 of the fastener tape 15. The terminal portion 22 does not exist on the tape surface of the fastener tape 15. The fastener element 20 extends in the left-right direction from the base portion 21, secured to the side-edge 16 of the fastener tape 15, toward the terminal portion 22, not existing on the tape surface of the fastener tape 15.

The terminal portion 22 of the fastener element 20 has a terminal surface 22*m* to be opposed to or touched by a coupling pillar 43 of the slider 40. In some cases, the terminal surface 22*m* touches the coupling pillar 43 of the slider 40 and slides on the side surface thereof. The base portion 21 of the fastener element 20 has a base end surface 21*m* to be opposed to or touched by a flange 44 of the slider 40. In some cases, the base end surface 21*m* touches the flange 44 of the slider 40 and slides on the inner surface thereof. The terminal surface 22*m* of the fastener element 20 touches and/or slides on the side surface of the coupling pillar 43 so that the posture of the fastener element 20 may be stabilized. Likewise, the base end surface 21*m* of the fastener element 20 touches and/or slides on the inner surface of the flange 44 so that the posture of the fastener element 20 may be stabilized. In some cases, the base end surface 21*m* and/or the terminal surface 22*m* includes at least partially a flat surface.

The base portion 21 of the fastener element 20 has an upper portion provided above the fastener tape 15 and a lower portion provided under the fastener tape 15. The base end surface 21*m* of the base portion 21 is divided into upper and lower sections by the fastener tape 15. The upper section of the base end surface 21*m* is opposed to, or touches or in some cases slides on the inner surface of the upper flange of the slider 40. The lower section of the base end surface 21*m* is opposed to, or touches or in some cases slides on the inner surface of the lower flange of the slider 40.

Interspace between the terminal surface 22*m* and the base end surface 21*m* in the left-right direction matches the width of the fastener element 20 in the left-right direction. The fastener element 20 has front and rear surfaces which extend between the base end surface 21*m* and the terminal surface 22*m*. The front surface extends in left-right direction so as to form a first recess 29 and an engaging protrusion 24 described below. The front surface is a surface that face frontward of the movement direction of the slider. The rear surface extends in left-right direction so as to form an engaged recess 25 described below. The rear surface is a surface that face rearward of the movement direction of the slider.

As shown in FIG. 2, the fastener element 20 has an intermediate portion 23 that is bent or curved between the terminal portion 22 and the base portion 21. The intermediate portion 23 has an engaging protrusion 24 and an engaged recess 25 which are respectively protruded and recessed on an axis CL that matches the movement direction of the slider 40. In some cases including the illustrated example, the engaging protrusion 24 protrudes moderately frontward. The vertex of the engaging protrusion 24 is positioned on the axis CL. The engaged recess 25 is moderately recessed frontward. The bottom point of the engaged recess 25 is positioned on the axis CL. As shown in FIG. 1, the axis CL is positioned at the center of an interspace W10 in the left-right direction between the respective base end surfaces 21*m* of the base portions 21 of the left and right coupled fastener elements 20. The axis CL is parallel to an elongated direction of the fastener tape 15. At the engaging protrusion 24 of the intermediate portion 23, the front surface of the fastener element 20 is bent or curbed in an arc so as to protrude frontward. At the engaged recess 25 of the intermediate portion 23, the rear surface of the fastener element 20 is bent or curbed in an arc so as to protrude frontward.

As shown in FIG. 2, the engaging protrusion 24 is positioned frontward beyond the region defined by a width W1 of the base portion 21 in the front-rear direction. That is, the frontward-most end of the engaging protrusion 24 is positioned forward than the frontward-most end of the base portion 21. On the other hand, the engaged recess 25 is positioned nearby the center of the width W1 of the base portion 21 in the front-rear direction. In particular, the vertex of the engaging protrusion 24 is positioned out of the maximum width W1 of the base portion 21, and the bottom point of the engaged recess 25 is positioned within the maximum width W1 of the base portion 21. Note that, the bottom point of the engaged recess 25 is positioned within a maximum width W2 of the terminal portion 22. The fastener element 20 is bent or curved such that the width of the fastener element 20 in the left-right direction would be reduced. Furthermore, undesired interference between to-be-coupled fastener elements 20 when the left and right fastener elements 20 are coupled would be suppressed, resulting in improved coupling therebetween when the coupling is completed. Note that, in the present specification, only illustrated is a case where the fastener element 20 is bent, and omitted is an illustration of a case where the fastener element 20 is curved.

In some cases, at least a part of the terminal portion 22 is positioned within the maximum width W1 of the base portion 21. In some cases, the terminal surface 22*m* of the terminal portion 22 is positioned within the maximum width W1 of the base portion 21.

In some cases, the fastener element 20 presents a bent shape of inverted V when viewed in elevation. In some cases, the fastener element 20 has first and second bars 27, 28. The boundary between the first and second bars 27, 28 may exist on the axis CL. The coupled portion of the first and second bars 27, 28 may be equal to the above-described intermediate portion 23. The second bar 28 includes the above-described terminal portion 22. The boundary between the first bar 27 and the base portion 21 may exist on an axis AX that is parallel to the axis CL and positioned at the center in the width of a core thread 17 in the left-right direction.

When the left and right fastener elements 20 are coupled, the left fastener element 20 is sandwiched between the right fastener elements 20 located adjacently on the right fastener tape 15. In some cases, the engaging protrusion 24 of the left fastener element 20 is engaged with the engaged recess 25 of the right fastener element 20 positioned at the front side. Likewise, the engaged recess 25 of the left fastener element 20 is engaged with the engaging protrusion 24 of the right fastener element 20 positioned at the rear side.

When the left and right fastener elements 20 are coupled, the front surface of the first bar 27 of the left fastener element 20 and the rear surface of the second bar 28 of the right fastener element 20 positioned at the front side may be opposed to or in contact one another. The rear surface of the first bar 27 of the left fastener element 20 and the front surface of the second bar 28 of the right fastener element 20 positioned at the rear side may be opposed to or in contact one another.

When the left and right fastener elements 20 are coupled, the front surface of the second bar 28 of the left fastener element 20 and the rear surface of the first bar 27 of the right fastener element 20 positioned at the front side may be opposed to or in contact one another. The rear surface of the second bar 28 of the left fastener element 20 and the front surface of the first bar 27 of the right fastener element 20 positioned at the rear side may be opposed to or in contact one another.

Even when the left fastener element 20 is moved leftward when left and right fastener elements 20 are coupled, the second bar 28 of the left fastener element 20 is interfered with the first bar 27 of the right fastener element 20 positioned at the rear side, and the first bar 27 of the left fastener element 20 is interfered with the second bar 28 of the right fastener element 20 positioned at the front side. The same applies to the right fastener elements 20 relative to the left fastener elements 20.

In some cases including the presently disclosed examples, an angle θ between the first and second bars 27, 28 satisfies $120° < \theta < 140°$. In a case of $120° > \theta$, when the left and right fastener elements 20 are coupled, the left and right fastener elements 20 are interfered with one another, increasing a required force for moving the slider 40 or making it impossible to suitably couple them. In a case of $\theta > 140°$, an interspace W3 between adjacent base portions 21 of the fastener elements 20 located on the same fastener tape 15 may be smaller, and the base portions 21 of the fastener elements 20 located on the same fastener tape 15 may be interfered one another or flexibility of the side-edge 16 of the fastener tape 15 may be lowered.

The relationship between the first and second bars 27, 28 applies to the relationship between the front surface of the first bar 27 and the front surface of the second bar 28 by which the engaging protrusion 24 is formed, and similarly applies to the relationship between the rear surface of the first bar 27 and the rear surface of the second bar 28 by which the engaged recess 25 is shaped.

In some cases, a first recess 29, which is different from the above-described engaged recess 25, may be located between the first bar 27 and the base portion 21 and at the same side as the engaging protrusion 24 in the front-rear direction. The first recess 29 is a recess that is recessed in the opposite direction of the protruding direction of the engaging protrusion 24 at the same side as the engaging protrusion 24. The first recess 29 is positioned on the core thread 17 of the fastener tape 15. In more detail, the bottom point of the first recess 29 may be positioned on the axis AX. The existence of the first recess 29 may cause an increase in the maximum width W1 of the base portion 21. As would be appreciated from FIG. 2, an interspace W4 between the vertex position of the engaging protrusion 24 and the bottom position of the first recess 29 in the front-rear direction is substantially equal to an interspace W5 between the rearmost point of the terminal portion 22 and the bottom position of the engaged recess 25. That is, the extent of protruding of the engaging protrusion 24 and the extent of depth of the engaged recess 25 are complementary. Accordingly, facilitated would be better coupling between the left and right fastener elements 20 of the same shape. Also, as appreciated from FIG. 1, when the left and right fastener stringers 10 are coupled, the terminal portion 22 of the right fastener element 20 enters into the first recess 29 of the left fastener element 20. Therefore, in a case where the first recess 29 is provided, an engagement angle between left and right fastener elements 20 would be greater (or deeper) compared with a case where the first recess 29 is not provided, increasing a lateral strength of slide fastener 100.

The front and rear surfaces of the first bar 27 extend substantially in parallel between the axis AX and the axis CL, obliquely with respect to the left-right direction. The front and rear surfaces of the second bar 28 extend substantially in parallel from the axis CL toward the outward side of fastener tape, obliquely with respect to the left-right direction.

As shown in FIGS. 2 to 4, in some cases, the terminal portion 22 of the fastener element 20 is provided with an accommodating recess 26 that accommodates the core thread 17 of the fastener tape 15 of the engagement-partner fastener stringer 10 when the paired fastener stringers 10 are coupled. The accommodating recess 26 extends in the front-rear direction, similar to the core thread 17. The accommodating recess 26 of the fastener element 20 accommodates the core thread 17 so that up-down displacement of the terminal portion 22 of the fastener element 20 at the time of coupling would be effectively restricted. As shown in FIG. 4, the accommodating recess 26 is located at the center in the thickness of the terminal portion 22 in the up-down direction. The terminal surface 22*m* of the terminal portion 22 is divided into upper and lower sections by the accommodating recess 26. The upper section of the terminal surface 22*m* touches a side surface of an upper portion of the coupling pillar 43 of the slider 40. The lower section of the terminal surface 22*m* touches a side surface of a lower portion of the coupling pillar 43 of the slider 40. The depth D26 of the accommodating recess 26 which extends in the front-rear direction is less than the width of the core thread 17 in the left-right direction.

The fastener element 20 may be made of metal, resin or other material. In a case where the fastener element 20 is made of metal, the base portion 21 of the fastener element 20 is bifurcated, and is secured to the side-edge 16 of the fastener tape 15 through a step of swaging. In a case where the fastener element 20 is made of resin, the fastener element 20 is secured to the side-edge 16 of the fastener tape 15 through a step of injection molding performed while the side-edge 16 of the fastener tape 15 is arranged inside a cavity of a mold. In cases where the fastener element 20 is made of other material, it may be secured to the side-edge 16 of the fastener tape 15 through any suitable manner for that material.

The slider 40 has an upper wing 41, a lower wing 42, a coupling pillar 43, and a flange 44. The coupling pillar 43 couples the upper wing 41 and the lower wing 42, and is opposed to or touched by the terminal surface 22*m* of the terminal portion 22 of the fastener element 20. The flange 44 is provided at least one of the upper wing 41 and the lower wing 42, and is opposed to or touched by the base end surface 21*m* of the base portion 21 of the fastener element 20. The slider 40 may be made of metal, resin or other material. The slider 40 has paired front mouths adjacent at the left and right sides of the coupling pillar 43, and the respective fastener elements 20 enter into the slider 40 through the front mouths respectively. The left and right fastener elements 20 coupled at the inside of the slider 40 moves out from the slider 40 through one rear mouth of the slider 40. In some cases, the upper wing 41 of the slider 40 is provided with a pull-attachment column to which any type of pull can be attached.

The upper and lower wings 41 and 42 are arranged to be opposed one another with an interspace that is equal to the height of the coupling pillar 43 in the up-down direction. The distance between the upper and lower wings 41 and 42 in the up-down direction is slightly greater than the maximum thickness of fastener element 20 in the up-down direction.

The coupling pillar 43 of the slider 40 has a cross-sectional shape of triangle, more precisely an isosceles triangle, having a maximum width at front side and a minimum width at a rear side. The coupling pillar 43 has a left-side surface 43*m* and right-side surface 43*n* which come closer one another rearward. The left-side surface 43*m* is a flat surface, ensuring smooth sliding of the left fastener element 20. The right-side surface 43*n* is a flat surface, ensuring smooth sliding of the right fastener element 20.

The coupling pillar 43 has a rounded rear end 43*r*. Angle between the left-side surface 43*m* and the right-side surface 43*n* may be set suitably, e.g. 35-45° in some cases, and 40° in the presently disclosed example. The coupling pillar 43 has a front surface 43*f* that crosses the front-rear direction at the right angle. Arc surface is provided between the left-side surface 43*m* and the front surface 43*f*, and arc surface is provided between the right-side surface 43*n* and the front surface 43*f*, facilitating smooth sliding of fastener elements 20.

The paired flanges 44 of the slider 40 have a maximum interspace in the left-right direction at a front side, and a minimum interspace in the left-right direction at the rear side. The paired flanges 44 include left and right flanges 44*m* and 44*n*. The left flange 44*m* has an inner surface 44*m*1 that is opposed to the right flange 44*n*. The right flange 44*n* has an inner surface 44*n*1 that is opposed to the left flange 44*m*. The base end surface 21*m* of the base portion 21 of the left fastener element 20 is opposed to, touches or slides on the inner surface 44*m*1 of the left flange 44*m*. The base end surface 21*m* of the base portion 21 of the right fastener element 20 is opposed to, touches or slides on the inner surface 44*n*1 of the right flange 44*n*.

In some cases including the presently disclosed examples, the upper wing 41 and the lower wing 42 are respectively provided with the paired flanges 44. That is, the slider 40 has a pair of upper flanges provided at the upper wing 41 and a pair of lower flanges provided at the lower wing 42. Total 4 flanges 44 may be provided so that an element passage between the upper wing 41 and the lower wing 42 would be suitably restricted. In some embodiments, the fastener element 20 may have a fin that will enter into a space between the upper and lower flanges. Variation is envisioned where the slider 40 has two flanges 44 only, in which one flange may possibly be provided at the upper wing 41 and the other one may possibly be provided at the lower wing 42.

In some cases including the presently disclosed examples, as shown in FIGS. 1 and 2, in the left-right direction orthogonal to the axis CL, a first distance L1 between the axis CL and the terminal surface 22*m* of the terminal portion 22 is less than a second distance L2 between the axis CL and the base end surface 21*m* of the base portion 21. According to such a configuration, a force required for moving the slider 40 for coupling the left and right fastener stringers 10 would be effectively reduced. In some cases, $0.39<P/Q<0.74$ is satisfied where P indicates the first distance L1; and Q indicates the second distance L2. In a case of $0.39>P/Q$, an element cannot reach at the core thread 17 on which an engagement-partner fastener element 20 is provided, possibly failing to restrict up-down displacement of the fastener element 20 when the elements are coupled. In a case of $P/Q>0.74$, a second bar 28 of a fastener element 20 may possibly be interfered with a fist bar 27 of the other fastener element 20 when the elements are coupled.

In some cases including the presently disclosed examples, $0.30<2P/T<0.70$ is satisfied where T indicates an interspace W10 in an orthogonal direction (i.e. in the left-right direction) between the respective base end surfaces 21*m* of the base portions 21 of the coupled fastener elements 20 in the pair of fastener stringers 10. In a case of $0.30>2P/T$, a fastener element 20 may not be able to reach a core thread 17 on which an engagement-partner fastener element 20 is provided, possibly failing to restrict up-down displacement of fastener element when the elements are coupled. In a case of 2P/T>0.70, a second bar 28 of a fastener element may possibly be interfered with a fist bar 27 of the other fastener element when the elements are coupled.

In some cases including the presently disclosed examples, in a direction parallel to the axis CL, the maximum width W1 of the base portion 21 is greater than the minimum width W2 of the terminal portion 22 so that attachment strength of fastener element 20 to the fastener tape 15 would be increased.

In some cases including the presently disclosed examples, in a direction parallel to the axis CL, 0.62<R/(R+S)<0.83 is satisfied where R indicates a maximum width W1 of the base portion 21, and S indicates a minimum interspace W3 of adjacent base portions 21 of fastener elements 20 on the same fastener tape 15. In a case of R/(R+S)>0.83, the respective base portions 21 of adjacent fastener elements 20 on the same fastener tape 15 may possibly be interfered with one another when the left and right fastener elements 20 are coupled. In a case of 0.62>R/(R+S), attachment strength of a fastener element 20 to a fastener tape 15 may be lowered and the base end surface 21*m* may not be able to have a sufficient area, possibly deteriorating a stability of posture of fastener element 20 inside a slider 40.

Referring to FIGS. 5 to 8, how the right fastener element 20A is coupled to the left fastener element 20B, 20C will be described. As a result of frontward movement of the slider 40, the terminal portion 22 of the fastener element 20A enters into a space between the respective terminal portions 22 of the fastener elements 20B, 20C as shown in FIGS. 5 and 6. In the fastener elements 20A to 20C, the first distance L1 is less than the second distance L2 as described above. Therefore, the terminal portion 22 of the fastener element 20A can smoothly enter into the interspace between the respective terminal portions 22 of the fastener elements 20B, 20C. Sufficient interspace is secured between the adjacent base portions 21 of fastener elements 20 on the same fastener tape 15, and flexibility of posture change of fastener element 20 is also secured.

As a result of further frontward movement of the slider 40, the fastener element 20A is pushed by the inner surface of the right flange and moves leftward as shown in FIGS. 6 and 7. Likewise, the fastener element 20B, 20C are pushed by the inner surface of the left flange and move rightward. The terminal portion 22 of the fastener element 20A overpasses the engaging protrusion 24 of the fastener element 20C. The engaged recess 25 of the fastener element 20A and the engaging protrusion 24 of the fastener element 20C are engaged. The terminal portion 22 and the second bar 28 of the fastener element 20B are pushed frontward by the fastener element 20A. The fastener element 20B does not strongly hinder the engagement between the fastener elements 20A and 20C.

As a result of further frontward movement of the slider 40, as shown in FIGS. 7 and 8, the fastener elements 20A to 20C are coupled; the engaging protrusion 24 of the fastener element 20A is engaged with the engaged recess 25 of the fastener element 20B; the engaged recess 25 of the fastener element 20A is engaged with the engaging protrusion 24 of the fastener element 20C. The fastener element 20B is pushed rearward when the engaged recess 25 of the fastener element 20D positioned next to and at the front side of the fastener element 20A is coupled to the engaging protrusion 24 of the fastener element 20B.

As described above, in some cases including the presently disclosed examples, in an orthogonal direction orthogonal to the axis CL (i.e. in the left-right direction), the first distance L1 between the axis CL and the terminal surface 22*m* of the terminal portion 22 is less than the second distance L2 between the axis CL and the base end surface 21*m* of the base portion 21. Therefore, as in FIGS. 5 to 8, the left and right fastener elements 20 would be suppressed from strongly interfered with one another when the elements are coupled, reducing a force required to pull the slider 40 for coupling the left and right fastener elements 20. As described above, in a case where 0.39<P/Q<0.74 is satisfied, a strength against a force for pulling apart in the left-right direction and a resistance against a thrust in the up-down direction would be suitably ensured while a force for pulling the slider 40 is reduced.

Working Example

Force of 0.9 N was required for moving a slider for coupling fastener elements in an example in which L1: 1.98 mm, L2: 3.40 mm, θ: 120°, W1: 2.09 mm, W2: 0.92 mm, W3: 0.81 mm, and angle between left-side and right-side surfaces 43*m*, 43*n* of the coupling pillar 43 of the slider 40:40°. In the type of slide fastener shown in FIG. 9, 2.0 to 4.0 N is required for moving a slider for coupling fastener elements.

In another working example, L1: 1.08 mm, L2: 2.80 mm, θ: 140°, W1: 1.84 mm, W2: 1.14 mm, W3: 0.71 mm, and angle between left-side and right-side surfaces 43*m*, 43*n* of the coupling pillar 43 of the slider 40: 40°. Force of 0.9 N was required for moving a slider for coupling fastener elements.

Further aspects of the present disclosure would be described further hereinafter with reference to FIGS. 10 to 38. FIG. 10 is a schematic and partial elevational view of a slide fastener 100 where a slider 40 is schematically illustrated by dash-dot line. FIG. 11 is a schematic and partial elevational view showing coupled left and right fastener stringers 10. FIG. 12 is a schematic end view taken along a two-dot chain line X12-X12 in FIG. 11. FIG. 13 is a schematic end view taken along a two-dot chain line X13-X13 in FIG. 11. FIGS. 14(*a*) and 14(*b*) are schematic perspective views of a fastener element 20 fixed to a fastener tape 15. FIG. 15 is a schematic elevational view of a fastener element 20 fixed to a fastener tape 15. FIG. 16 is a schematic end view taken along a two-dot chain line X16-X16 in FIG. 15, showing a sloped surface 36 provided on a terminal portion 22 of fastener element 20. FIG. 17 is a schematic end view taken along a two-dot chain line X17-X17 in FIG. 15, showing a locking wall 33 provided on a fastener element 20. FIG. 18 is a schematic front view of a fastener element 20 fixed to a fastener tape 15. FIG. 19 is a schematic rear view of a fastener element 20 fixed to a fastener tape 15. FIG. 20 is a schematic side view of a fastener element fixed to a fastener tape, showing a terminal surface 22*m* of a terminal portion 22 of fastener element 20.

Unlike the fastener element 20 shown in FIGS. 1 to 8, a fastener element 20 of the present FIG. 10 etc. does not present a bent shape of inverted V when viewed in elevation, but does have an intermediate portion 23 that is equivalent to the intermediate portion of the fastener element 20 shown in FIGS. 1 and 2. As shown in FIG. 11, the intermediate portion 23 has an engaging protrusion 24 and an engaged recess 25 which are respectively protruded and recessed on an axis CL that matches a movement direction of the slider 40. Furthermore, in an orthogonal direction orthogonal to the axis CL (i.e. in the left-right direction), the first distance L1 between the axis CL and the terminal surface 22*m* of the terminal portion 22 is less than the second distance L2 between the axis CL and the base end surface 21*m* of the base portion 21. Force required for moving the slider 40 for coupling the left and right fastener stringers 10 would be effectively reduced, and the slider 40 can be moved much easier with lesser force.

There is no change that, when left and right fastener elements 20 are coupled, the engaging protrusion 24 of the fastener element 20 at one side of the left and right sides is engaged or fitted with the engaged recess 25 of the fastener element 20 of the other side of the left and right sides. In the embodiment disclosed in FIGS. 1-8, the fastener element 20 included in the fastener stringer 10 at one side of the left and right sides can be engaged with the fastener tape 15, more particularly a core thread 17 of the fastener stringer 10 at the other side of the left and right sides. In contrast, in the disclosed embodiment of FIGS. 10 to 38, the fastener element 20 (in particular, a terminal portion 22) at one side of the left and right sides can be engaged with a displacement-restricting portion 30 of the (engagement-partner) fastener element 20 at the other side of the left and right sides, thus its up-down displacement would be prevented. As the fastener element 20 is harder than the core thread 17, the up-down displacement of the fastener element 20 would be sufficiently prevented. The left-right length of the fastener element 20 would be reduced and the interspace W10 would be reduced. As a result, use of conventional sliders (See FIG. 10) would be facilitated without a need of use of dedicated or special sliders (See FIG. 1). Avoiding the use of dedicated or special sliders would allow an increased efficiency of manufacturing of slide fasteners (or a reduced burden of management of manufacturing of slide fasteners), or allows to facilitate the reduction of price of slide fastener.

As would be appreciated from FIG. 11, the fastener element 20 has at least one displacement-restricting portion 30 provided adjacent to the intermediate portion 23 or a pair of displacement-restricting portion 30 arranged to sandwich the intermediate portion 23 in the front-rear direction. The displacement-restricting portion 30 protrudes from the base portion 21 outwardly of fastener tape. The displacement-restricting portion 30 positioned at the front side of the intermediate portion 23 is provided to occupy at least partially a space between the engaging protrusion 24 and the base portion 21. The displacement-restricting portion 30 positioned at the rear side of the intermediate portion 23 extends from the base portion 21 toward the terminal portion 22 (a first protuberance 31 described below). The displacement-restricting portion 30 is provided at the center position or height in the thickness of the base portion 21 along the up-down direction, but not necessarily limited thereto. The displacement-restricting portion 30 may be referred to as a shoulder in the case of FIG. 11.

Various manners are envisioned regarding engagement between the terminal portion 22 of the fastener element 20 and the displacement-restricting portion 30 of the engagement-partner fastener element 20. As shown in FIGS. 11 to 13, the terminal portion 22 of the fastener element 20 is provided with an accommodating recess 26 that accommodates the displacement-restricting portion 30. The accommodating recess 26 has a concavity that extends in parallel to the axis CL, but not necessarily limited thereto. Regarding the coupled two fastener elements 20, the accommodating recess 26 of the terminal portion 22 of one fastener element 20 accommodates the displacement-restricting portion 30 of the other fastener element 20, thereby preventing displacement of fastener element 20 in the up-down direction. For example, the fastener elements 20 are prevented from locally decoupled in accordance of flexure of slide fastener 100 along the elongated direction thereof, for example. Note that, in one fastener element 20, the accommodating recess 26 is positioned away from the base portion 21 farther than the engaging protrusion 24 and the engaged recess 25.

As shown in FIG. 12 and FIG. 13, in the embodiment where the displacement-restricting portion 30 is provided at the center position or height in the thickness of the base portion 21 along the up-down direction, the accommodating recess 26 is provided at the center position or height in the thickness of the terminal portion 22 of the fastener element 20 along the up-down direction. The terminal portion 22 of the fastener element 20 has an upper portion 22*p* and a lower portion 22*q* which are arranged to sandwich the accommodating recess 26 (See FIGS. 12 and 13).

The rear end of the terminal portion 22 of the fastener element 20 is provided with a first protuberance 31 that protrudes in a direction opposite to the depth direction of the engaged recess 25 (i.e. rearward). Alternatively or additionally, the front end of the terminal portion 22 of the fastener element 20 is provided with a second protuberance 32 that protrudes in the same direction as the engaging protrusion 24 (i.e. frontward) with an amount of protruding less than an amount of protruding of the engaging protrusion 24. The accommodating recess 26 would be elongated longer, facilitating more sufficient engagement between the accommodating recess 26 and the displacement-restricting portion 30. In some cases, the upper portion 22*p* and the lower portion 22*q* of the terminal portion 22 of the fastener element 20 are respectively provided with first and second protuberances 31, 32, not necessarily limited to through.

Note that, in view of interrelationship of planes B1, T1 and T2 shown in FIG. 15, it would be possible to understand that the second protuberance 32 has an amount of protruding that is lesser than that of the engaging protrusion 24. Distance between a plane B1 set at a bottom position of an intermediate recess 34 (described below) located between the second protuberance 32 and the engaging protrusion 24 and a plane T1 set at the vertex of the second protuberance 32 is less than a distance between the plane B1 and a plane T2 that is set at the vertex of the engaging protrusion 24. Note that, each of the planes B1, T1 and T2 is a plane that is orthogonal to the axis CL.

Similar to the embodiment shown in FIGS. 1 to 8, the fastener element 20 has a first recess 29 that is recessed between the engaging protrusion 24 and the base portion 21 (See FIG. 11). Unlike the embodiment shown in FIGS. 1 to 8, the first recess 29 is not positioned on the core thread 17 but is positioned outwardly of fastener tape than the core thread 17. Regarding two coupled fastener elements 20, the first protuberance 31 of the terminal portion 22 of one fastener element 20 is engaged with the first recess 29 of the other fastener element 20. More sufficient engagement of the engaging protrusion 24 and the engaged recess 25 would be facilitated.

As shown in FIGS. 12 and 13, in an embodiment where the displacement-restricting portion 30 is provided at a center position or height in the thickness of the base portion 21 along the up-down direction, the first recess 29 is divided into upper and lower sections by the displacement-restricting portion 30. As shown in FIG. 12, the first recess 29 has upper and lower recesses 29*p* and 29*q* which are arranged to sandwich the displacement-restricting portion 30 in the up-down direction. Regarding two coupled fastener elements 20, the upper portion 22*p* of the terminal portion 22 of one fastener element 20 is arranged in the upper recess 29*p* of the first recess 29 of the other fastener element 20. Likewise, the lower portion 22*q* of the terminal portion 22 of one fastener element 20 is arranged in the lower recess 29*q* of the first recess 29 of the other fastener element 20. The displacement-restricting portion 30 is sandwiched between the upper portion 22*p* and the lower portion 22*q* of the terminal portion 22 of the fastener element 20. The same explanation as the first recess 29 would apply to the second recess 39, and thus overlapping description would be omitted. Note that, the second recess 39 has upper and lower recesses 39*p* and 39*q* which are arranged to sandwich the displacement-restricting portion 30 in the up-down direction.

Unlike the embodiment shown in FIGS. 1 to 8, the fastener element 20 has a second recess 39 that is recessed at a position between the engaged recess 25 and the base portion 21 (See FIG. 11). The first recess 29 and the second recess 39 are arranged to sandwich the intermediate portion 23 (an extending portion 23*j* described below) in the front-rear direction. The second recess 39 is provided outwardly of fastener tape than the core thread 17. Regarding two coupled fastener elements 20, the second protuberance 32 of the terminal portion 22 of one fastener element 20 is engaged with the second recess 39 of the other fastener element 20. More sufficient engagement of the engaging protrusion 24 and the engaged recess 25 would be facilitated. An intermediate protrusion 38 is provided between the engaged recess 25 and the second recess 39. When the left and right fastener elements 20 are coupled, the intermediate protrusion 38 of the front-side fastener element 20 enters into the intermediate recess 34 located between the second protuberance 32 and the engaging protrusion 24 of the rear-side fastener element 20, thereby facilitating more sufficient engagement between the second protuberance 32 and the second recess 39. The intermediate protrusion 38 is projected rearward. The intermediate recess 34 is recessed rearward.

As would be understood from the above description, various shapes of fastener elements 20 would be envisioned. In some cases, the terminal portion 22 of the fastener element 20 has a taper portion 37 that has a tapered width along a direction from the engaging protrusion 24 toward the engaged recess 25. In the illustrated example, the terminal portion 22 of the fastener element 20 has a pair of sloped surfaces 36 that extend along the axis CL, and the paired sloped surface 36 come closer one another as extending along the direction from the engaging protrusion 24 to the engaged recess 25. Accordingly, lowered would be a possibility that the fastener element 20 touches the upper and lower wings 41, 42 of the slider 40 and, when the slider 40 moves frontward while the fastener stringer 10 is twisted, it would be suppressed that the fastener elements 20 do not enter into the slider 40 suitably and smooth movement of the slider 40 is hindered. Note that, an embodiment is envisioned where one of the paired sloped surfaces 36 is replaced by a flat surface. That is, there is no need for the taper portion 37 to be configured symmetrically with respect to a plane such as a plane parallel to the fastener tape 15.

The sloped surface 36 may provide a sliding surface for a locking pawl 45 that may be incorporated into the slider 40, in addition to or as an alternative to facilitate smooth entering of fastener elements 20 into the slider 40. Concretely, the locking pawl 45 incorporated into the slider 40 slides on the sloped surfaces 36 when the slider 40 moves frontward. Accordingly, the movement of the slider 40 into which the locking pawl 45 is incorporated would be smoother. For this purpose, the sloped surface 36 extends to cross the axis CL in the left-right direction. Accordingly, the locking pawl 45, designed to move along the axis CL, would be allowed to slide on the sloped surface 36 smoothly. Additionally or alternatively, the sloped surface 36 extends from the terminal portion 22 toward the base portion 21 of the fastener element 20. As a further addition or alternative, the sloped surface 36 is formed across the terminal portion 22 and the intermediate portion 23 of the fastener element 20. In other words, the sloped surface 36 includes a first region included in the terminal portion 22 of the fastener element 20 and a second region included in the intermediate portion 23. In the illustrated example, the sloped surface 36 is a sloped surface that is slanted downward along a direction from the front-side to the rear-side and formed across the terminal portion 22 and the intermediate portion 23. When the slider 40 moves frontward, the locking pawl 45 can easily ride over the fastener element 20 or the fastener element 20 can be protected from being scratched by the locking pawl 45.

In some cases, the fastener element 20 has a locking wall 33 by which the locking pawl 45 of the slider 40 can be locked, and the engaging protrusion 24 protrudes (frontward) from the locking wall 33. The locking wall 33 may be formed, for example, by providing a recess at the upper or lower surface of the intermediate portion 23 of the fastener element 20 or by forming the engaging protrusion 24 at the extending portion 23*j* of the intermediate portion 23 (described below). The locking pawl 45 of the slider 40 is urged downward by an elastic member such as a leaf spring within the slider 40. The locking pawl 45 of the slider 40 can be moved upward in accordance with operation of the pull tab of the slider 40. When human nips the pull tab of the slider 40 and moves the slider 40, the locking pawl 45 of the slider 40 can ride over the locking wall 33. As would be appreciated from FIGS. 17 and 18, the engaging protrusion 24 may have a size in the up-down direction that is greater than the width of the accommodating recess 26 in the up-down direction. Even when the locking wall 33 is provided, more sufficient engagement between the engaging protrusion 24 and the engaged recess 25 would be facilitated.

Segmentation of the base portion 21, the terminal portion 22, and the intermediate portion 23 is illustrated in FIG. 15, but not necessarily limited thereto. The base portion 21 is a portion secured to the fastener tape 15. The terminal portion 22 is provided at the opposite side relative to the base portion 21 in the fastener element 20 that extends away from the fastener tape 15. The intermediate portion 23 is provided between the base portion 21 and the terminal portion 22. Likewise the embodiment shown in FIGS. 1-8, the fastener element 20 includes a bent or curved portion between the terminal portion 22 and the base portion 21. In the illustrated example, the fastener element 20 includes the first and second bars 27, 28 (See FIG. 15). In the illustrated example, as shown in FIG. 15, the intermediate portion 23 includes the extending portion 23*j* that extends from the base portion 21 toward the terminal portion 22. The engaging protrusion 24 protrudes frontward from the front surface of the extending portion 23*j* of the intermediate portion 23. The engaged recess 25 is a recess provided at the rear surface of the extending portion 23*j* of the intermediate portion 23.

The front surface of the extending portion 23*j* of the intermediate portion 23 extends so as to shape the first recess 29, the locking wall 33 and the second protuberance 32. The rear surface of the extending portion 23*j* of the intermediate portion 23 extends so as to shape the second recess 39, the intermediate protrusion 38, the engaged recess 25 and the first protuberance 31. Note that, the locking wall 33 is a part of the front surface of the extending portion 23*j* of the intermediate portion 23. Note that, the front-side displacement-restricting portion 30 is coupled to the front surface of the extending portion 23*j* of the intermediate portion 23. The rear-side displacement-restricting portion 30 is coupled to the rear surface of the extending portion 23*j* of the intermediate portion 23.

Similar to the embodiment shown in FIGS. 1 to 8, the engaging protrusion 24 includes an angular portion positioned on the axis CL, and the engaged recess 25 includes a concavity that is positioned on the axis CL and is shaped complementary to the angular portion 24*c*. In some cases, the engaging protrusion 24 is configured to have a width in the left-right direction that is narrowed toward the front-side and, for example it is V-shaped by the pair of sloped surfaces 24*a*, 24*b*. The paired sloped surfaces 24*a*, 24*b* come closer as extending frontward along the axis CL. One sloped surface 24*a* is slanted frontward as extending along a direction from the base portion 21 toward the terminal portion 22. The other sloped surface 24*b* is slanted frontward as extending along a direction from the terminal portion 22 toward the base portion 21. Cross point of the paired sloped surfaces 24*a*, 24*b* is at a vertex of the V-shaped engaging protrusion 24 (the angular portion). The vertex of the V-shaped engaging protrusion 24 may be positioned on the axis CL. Similarly, the engaged recess 25 is configured to be narrower in the left-right direction toward the front-side and, for example is defined to be V-shaped by a pair of sloped surfaces 25*a*, 25*b*. The paired sloped surfaces 25*a*, 25*b* come closer one another as extending frontward along the axis CL. One sloped surface 25*a* is slanted frontward as extending along a direction from the base portion 21 toward the terminal portion 22. The other sloped surface 25*b* is slanted frontward as extending along a direction from the terminal portion 22 toward the base portion 21. Cross point of the paired sloped surfaces 25*a*, 25*b* is at a bottom point of the V-shaped engaged recess 25 (the concavity). The bottom point of the V-shaped engaged recess 25 may be positioned on the axis CL.

The paired sloped surfaces 24*a*, 24*b* of the engaging protrusion 24 are substantially symmetrical with respect to the axis CL. Likewise, the paired sloped surfaces 25*a*, 25*b* of the engaged recess 25 are substantially symmetrical with respect to the axis CL. Furthermore, the sloped surfaces 24*a*, 25*a* are in parallel one another at least partially, and the sloped surfaces 24*b*, 25*b* are in parallel one another at least partially. Based on such features, it would be readily appreciated that the fastener element 20 includes the first and second bars 27, 28 similar to the embodiment shown in FIGS. 1 to 8. That is, the first and second bars 27, 28 shown by dotted lines in FIG. 15 are included in the fastener element 20. The angle θ between the first and second bars 27, 28 satisfies $120° < \theta < 140°$.

The second protuberance 32 protrudes frontward from the front surface of the second bar 28. The second recess 39 is formed at the rear surface of the first bar 27. Engagement of the second protuberance 32 and the second recess 39 increases the resistance of the slide fastener 100 against a lateral pulling force.

Here, with reference to FIG. 21, we are going to consider about a difference between conventional and presently disclosed fastener elements. FIG. 21(*a*) shows a fastener element 20 according to the present disclosure, and FIG. 21(*b*) shows a conventional fastener element 20'. The conventional fastener element 20' has a base portion 21', a head portion 22' and a neck portion 23'. It would be appreciated that a protruded portion 24' extending frontward in the head portion 22' of the conventional fastener element 20 is shifted toward the base portion 21' as illustrated by an arrow to arrive at a position where the engaging protrusion 24 of the presently disclosed fastener element 20 is located. That is, in the presently disclosed fastener element 20, the engaging protrusion 24 is provided at a position shifted closer to the base portion 21 than the first protuberance 31 in the left-right direction, and the first recess 29 is provided at a position shifted closer to the base portion 21 than the engaged recess 25 in the left-right direction. Therefore, even when a force required for moving the slider 40 is reduced, it would be possible to facilitate that the strength of slide fastener 100 against a lateral pulling force is improved.

The engaging protrusion 24 is a frontward-most protruding portion in the terminal portion 22 and the intermediate portion 23 of the fastener element 20, and has a front-side vertex A. The first protuberance 31 is a rearward-most protruding portion in the terminal portion 22 and the intermediate portion 23 of the fastener element 20, and has a rear-side vertex B. Furthermore, the engaged recess 25 is a frontward-most recessed portion in the terminal portion 22 and the intermediate portion 23 of the fastener element 20, and has a rear-side bottom point C. The first recess 29 is a rearward-most recessed portion in the terminal portion 22 and the intermediate portion 23 of the fastener element 20, and has a front-side bottom point D. Interspace W11 between a first plane parallel to the axis CL and including the vertex A and a second plane parallel to the axis CL and including the vertex B is equal to an interspace W12 between a third plane parallel to the axis CL and including the bottom point C and a fourth plane parallel to the axis CL and including the bottom point D. Likewise, the interspace between the first and fourth planes is equal to the interspace between the second and third planes.

When the left and right fastener elements 20 are coupled, the engaging protrusions 24 and the engaged recesses 25 of the respective left and right fastener elements 20 are arranged on the same axis. Similarly, the first protuberances 31 and the first recesses 29 of the respective left and right fastener elements 20 are arranged on the same axis. According to such an aspect, an interference caused when one of left and right fastener elements 20 enters into a space between the other ones of left and right fastener elements 20 would be reduced, and the following coupling between the left and right fastener elements 20 would be strengthened.

In the front-rear direction, the bottom point F of the second recess 39 is positioned between the bottom point C of the engaged recess 25 and the vertex B of the first protuberance 31. In the front-rear direction, the bottom point E of the intermediate recess 34 is positioned between the vertex A of the engaging protrusion 24 and the bottom point D of the first recess 29.

Note that, as appreciated from FIG. 21, similar to the embodiment shown in FIGS. 1 to 8, an interspace W4 between the bottom point of the first recess 29 and the vertex position of the engaging protrusion 24 in the front-rear direction is substantially equal to an interspace W5 between the bottom position of the engaged recess 25 and the rearmost point of the terminal portion 22 (the first protuberance 31 in particular).

FIG. 22 is a schematic elevational view of a fastener element. As shown in FIG. 22, the locking wall 33 by which the locking pawl 45 of slider 40 can be locked extends up to the terminal surface 22*m* of the terminal portion 22 of the fastener element 20. According to such an aspect, even in a condition shown in FIG. 10, engagement between the locking pawl 45 and the locking wall 33 would be ensured, and stop positions for the slider 40 can be set with narrower pitch. The locking pawl 45 can touch the respective locking walls 33 of both left and right fastener elements 20. When the movement direction of the slider 40 matches a vertical direction, after the slider 40 is moved frontward and released, the locking pawl 45 can touch the locking walls 33 of either one of the left and right fastener elements 20, thus hindering rearward movement of the slider 40. The fastener element 20 has a non-flat curved surface 46 that is directed rearward gradually as extending from the engaged recess 25 toward the first protuberance 31, thereby increasing the strength of slide fastener 100 against a lateral pulling force.

Further description will be followed with reference to FIGS. 23 to 28. FIG. 23 is a schematic and partial elevational view showing coupled left and right fastener stringers 10 of a slide fastener 100, the base portion 21 of fastener element 20 having first and second legs 51, 52. FIG. 24 is a schematic end view taken along a two-dot chain line X24-X24 in FIG. 23. FIG. 25 is a schematic end view taken along a two-dot chain line X25-X25 in FIG. 23. FIG. 26 is a schematic elevational view of a fastener element 20 fixed to a fastener tape 15. FIG. 27 is a schematic end view taken along a two-dot chain line X27-X27 in FIG. 26. FIG. 28 is a schematic end view taken along a two-dot chain line X28-X28 in FIG. 26.

In the present embodiment, the base portion 21 is configured to cause an opposite rotational moment to reduce a rotational moment caused in accordance with engagement of the engaging protrusion 24 and the engaged recess 25, when the pair of fastener stringers 10 are pulled apart laterally. Looking at the fastener elements 20 labelled by 20F, 20G and 20H in FIG. 23, when the paired fastener stringers 10 are pulled apart laterally, a position P1 where the engaging protrusion 24 of the fastener element 20F receives a force F1 from the terminal portion 22 of the fastener element 20G is different from a position P2 where the terminal portion 22 of the fastener element 20F receives a force F2 from the engaging protrusion 24 of the fastener element 20H in the left-right direction. As a result, a rotational moment is caused which rotates the fastener element 20F clockwise. The base portion 21 is configured to cause a rotational moment that is opposite and to reduce this rotational moment.

When the paired fastener stringers 10 are pulled apart laterally, the right fastener stringer 10 is pulled apart from the left fastener stringer 10, and the left fastener stringer 10 is pulled apart from the right fastener stringer 10. The coupled fastener elements 20 each is pulled outward in the left-right direction by the core thread 17 of the fastener tape 15 to which it is coupled. In a case where the base portion 21 is provided with at least one notch 53 that reaches the core thread 17 of the fastener tape 15, a distribution of force applied from the core thread 17 to the base portion 21 of the fastener element 20 would be fluctuated along a direction the core thread 17 extends. The notch 53 is positioned appropriately so that an oppositely-directed rotational moment is caused which allows the fastener element 20F to rotate counterclockwise when the paired fastener stringers 10 are pulled apart laterally. In some cases, at least a portion 17*e* of the core thread 17 at the side of the base end surface 21*m* of the base portion 21 is exposed through the notch 53.

The notch 53 extends from the base end surface 21*m* toward the terminal portion 22 until it reaches the core thread 17 so that the upper surface of the fastener tape 15 is exposed. As a result, the base portion 21 has a first leg 51 provided at a side of the engaged recess 25 (i.e. at rear-side) and a second leg 52 provided at a side of the engaging protrusion 24 (i.e. at front-side). The first leg 51 and the second leg 52 are provided to sandwich the notch 53. The contact area of the first leg 51 with the fastener tape 15 is greater than the contact area of the second leg 52 with the fastener tape 15. The width W51 of the first leg 51 along the extending direction of the core thread 17 is greater than the width W52 of the second leg 52. In some cases, the following condition is satisfied so that magnitude of rotational moment would be set appropriately.

$$1.2<(W51/W52)<3$$

In the embodiment shown in FIGS. 23 to 28, the fastener element 20 has individual features such as the first protuberance 31, the second protuberance 32, the locking wall 33, the sloped surface 36, the first recess 29 and the second recess 39, but embodiments are envisioned where one or more selected features are omitted.

In the embodiment shown in FIGS. 29 and 30, the first leg 51 is partially thinned in a region at the side of the second leg 52 such that the width of the first leg 51 appears to be reduced. In other words, the first leg 51 has a recess (or step) 54 provided at the side of the second leg 52, so that the first leg 51 appears to have a reduced width 51' from the width W51. Accordingly, the first and second legs 51, 52 appear to extend with equivalent or closer widths. This avoids a problem that the base portion 21 appears to be asymmetry as a result of that the notch 53 is provided at the side of the second leg 52 so as to cause a rotational moment opposite to the rotational direction the fastener element 20 rotates when the paired fastener stringers 10 are pulled apart in the left-right direction, for example. Note that the step surface 55 of the recess 54 should not be limited to a horizontal surface and may be a sloped surface. As shown in FIG. 31, the notch 53 may be provided such that the first leg 51 only exists. As shown in FIG. 32, additionally or alternatively to the notch 53, a hole 53 may be provided at a position closer to a front side of the base portion 21. Even in such a case, it is expected that a similar result is obtained as described above based on the same principle described above. An embodiment is envisioned where the notch 53 or the hole 53 is provided at only one side of the upper and lower sides of the fastener element 20 relative to the fastener tape 15.

In an embodiment shown in FIGS. 33 to 38, the fastener element 20 is configured differently i.e. to have different shapes in an upper half 61 at the side of upper surface of the fastener tape 15 and a lower half 62 at the side of lower surface of the fastener tape 15. In one sense, the fastener element 20 is configured to be asymmetry, i.e. have asymmetrical shapes with respect to a plane where the fastener tape 15 exists. The upper half 51 of the fastener element 20 has a rectangular contour, taking a design functionality of fastener element 20 (See FIG. 33), not necessarily limited to this though. In contrast, the lower half 62 of the fastener element 20 has the base portion 21, the terminal portion 22 and the intermediate portion 23 similarly as described above, taking a coupling functionality of fastener element 20. Even in such a case, the same effect as described above would be obtained unless there is no inconsistency.

The upper half 61 of the fastener element 20 has a cover 63 that covers an interspace between the left and right fastener tape 15. The cover 63 protrudes from the fastener tape 15 outwardly of fastener tape. When the left and right fastener stringers 10 are closed, the upper halves 61 of adjacent fastener elements 20 in the left-right direction are in contact with or engaged with one another. The cover 63 may include one or more or a pair of displacement-restricting portions 30. In one fastener element 20, the intermediate portion 23 of the lower half 62 of the fastener element 20 is coupled to the cover 63 of the upper half 61 of the fastener element 20. The engaging protrusion 24 of the intermediate portion 23 either is coupled to the cover 63 of the upper half 61. The extending portion 23*j* of the intermediate portion 23 of the lower half 62 extends from the base portion 21 farther than the cover 63 of the upper half 61. The terminal portion 22 of the lower half 62 is positioned farther from the base portion 21 than the cover 63 of the upper half 61. Regarding coupled two fastener elements 20, a displacement-restricting portion 30 of one fastener element 20 is placed onto the upper surface 35 of the intermediate portion 23 and the terminal portion 22 of the other fastener element 20.

In a slide fastener 100 according to the embodiment shown in FIGS. 10 to 38, as an additional or alternative of the slider 40 shown in FIG. 10, an additional or alternative slider 40 can be included that may close the left and right fastener stringers 10 by moving in the opposite direction (i.e. rearward in the movement direction of the slider 40) relative to the slider 40 shown in FIG. 10.

Following inventions are also disclosed in the present disclosure. Individual features or combinations of individual features can be applied to the respective inventions described in the appendix below.

—Appendix 1—

A slide fastener (100) comprising: a pair of fastener stringers (10) wherein each fastener stringer (10) includes a fastener tape (15) and a plurality of fastener elements (20) attached to the fastener tape (15), each fastener element (20) including a base portion (21) secured to the fastener tape (15) and a terminal portion (22) positioned opposite to the base portion (21); and at least one slider (40) for opening and closing the pair of fastener stringers (10), the slider (40) including an upper wing (41), a lower wing (42), a coupling pillar (43) and a flange (44), the coupling pillar (43) coupling the upper wing (41) and the lower wing (42), the coupling pillar (43) being opposed to or touched by a terminal surface (22*m*) of the terminal portion (22) of the fastener element (20), the flange (44) being provided at least one of the upper wing (41) and the lower wing (42), and the flange (44) being opposed to or touched by a base end surface (21*m*) of the base portion (21) of the fastener element (20), wherein the fastener element (20) has an intermediate portion (23) including bent or curved portion between the terminal portion (22) and the base portion (21), the intermediate portion (23) has an engaging protrusion (24) and an engaged recess (25) which are respectively protruded and recessed on an axis (CL) that matches a movement direction of the slider (40), and the base portion (21) is configured to cause an opposite rotational moment to reduce a rotational moment caused in accordance with engagement of the engaging protrusion (24) and the engaged recess (25), when the pair of fastener stringers (10) are pulled apart laterally.

—Appendix 2—

A slide fastener (100) comprising: a pair of left and right fastener stringers (10) wherein each fastener stringer (10) includes a fastener tape (15) and a plurality of fastener elements (20) attached to the fastener tape (15), each fastener element (20) including a base portion (21) secured to the fastener tape (15) and a terminal portion (22) positioned opposite to the base portion (21); and at least one slider (40) that moves frontward to close the pair of left and right fastener stringers (10) and moves rearward to open the pair of left and right fastener stringers (10), wherein each of the left and right fastener elements (20) is bent or curbed to have an engaging protrusion (24) at the front side of the fastener element (20) and an engaged recess (25) at the rear side of the fastener element (20), the fastener element (20) at one side of the left and right sides is provided with a first recess (29) between the engaging protrusion (24) and the base portion (21), the first recess (29) being configured to receive a first protuberance (31) that is protruded rearward and is provided on the fastener element (20) at the other side of the left and right sides, in the respective left and right fastener elements (20), the engaging protrusion (24) is provided at a position shifted closer to the base portion (21) than the first protuberance (31) in a left-right direction, and the first recess (29) is positioned at a position shifter closer to the base portion (21) than the engaged recess (25) in the left-right direction.

—Appendix 3—

A slide fastener (100) comprising: a pair of left and right fastener stringers (10) wherein each fastener stringer (10) includes a fastener tape (15) and a plurality of fastener elements (20) attached to the fastener tape (15), each fastener element (20) including a base portion (21) secured to the fastener tape (15) and a terminal portion (22) positioned opposite to the base portion (21); and at least one slider (40) for opening and closing the pair of left and right fastener stringers (10), wherein each of the left and right fastener elements (20) has an intermediate portion (23) including bent or curved portion between the terminal portion (22) and the base portion (21), the intermediate portion (23) has an engaging protrusion (24) and an engaged recess (25) which are respectively protruded and recessed on an axis (CL) that matches a movement direction of the slider (40), and the fastener element (20) at one side of the left and right sides has at least one displacement-restricting portion (30) that prevents displacement, along an up-down direction, of the fastener element (20) at the other side of the left and right sides.

Based on the above teaching, a skilled person in the art would be able to add various modifications to the respective embodiments. Reference numerals in Claims are just for reference and should not be referred for the purpose of narrowly construing the scope of claims.

REFERENCE SIGNS LIST

100 Slide fastener
10 Fastener stringer
15 Fastener tape
16 Side-edge portion
17 Core thread
20 Fastener element
21 Base portion
21*m* Base end surface
22 Terminal portion
22*m* Terminal surface
23 Intermediate portion
24 Engaging protrusion
25 Engaged recess
40 Slider
41 Upper wing
42 Lower wing
43 Coupling pillar
44 Flange
L1 First distance
L2 Second distance
CL Axis

The invention claimed is:

1. A slide fastener comprising:

a pair of left and right fastener stringers, wherein each fastener stringer includes a fastener tape and a plurality of fastener elements attached to the fastener tape, each fastener element including a base portion secured to the fastener tape and a terminal portion positioned opposite to the base portion, the fastener element extending along a left-right direction between the base portion and the terminal portion; and at least one slider for opening and closing the pair of left and right fastener stringers, the slider including an upper wing, a lower wing, a coupling pillar and a flange, the coupling pillar coupling the upper wing and the lower wing, the coupling pillar being opposed to or touched by a terminal surface of the terminal portion of the fastener element, the flange being provided at least one of the upper wing and the lower wing, and the flange being opposed to or touched by a base end surface of the base portion of the fastener element, wherein:

the slide fastener has an axis defining a movement direction of the at least one slider relative to the plurality of fastener elements and along the pair of left and right fastener stringers, the fastener element has an intermediate portion including bent or curved portion between the terminal portion and the base portion, the bent or curved portion being bent or curved along the axis, the intermediate portion has an engaging protrusion and an engaged recess which are respectively protruded and recessed on the axis within a maximum width of the base end surface of the base portion along the axis, in the left-right direction orthogonal to the axis, a first distance between the axis and the terminal surface of the terminal portion is less than a second distance between the axis and the base end surface of the base portion, and the fastener element has a first recess recessed between the engaging protrusion and the base portion.

2. The slide fastener according to claim 1, wherein the engaging protrusion includes an angular portion positioned on the axis, and the engaged recess includes a concavity that is positioned on the axis and is shaped complementary to the angular portion.

3. The slide fastener according to claim 1, wherein the terminal portion of the fastener element is provided with a first protuberance protruded along the axis in a direction opposite to a direction the engaged recess is recessed.

4. The slide fastener according to claim 1, wherein the base portion is configured to cause an opposite rotational moment to reduce a rotational moment caused in accordance with engagement of the engaging protrusion and the engaged recess, when the pair of left and right fastener stringers are pulled apart laterally.

5. The slide fastener according to claim 1, wherein $0.39<P/Q<0.74$ is satisfied where P indicates the first distance; and Q indicates the second distance.

6. The slide fastener according to claim 5, wherein $0.30<(2P/T)<0.70$ is satisfied where T indicates an interspace in the orthogonal left-right direction between the respective base end surfaces of the base portions of the coupled fastener elements in the pair of left and right fastener stringers.

7. The slide fastener according to claim 1, wherein the fastener element includes first and second bars, an angle θ between the first bar (27) and the second bar satisfies: $120°<\theta<140°$.

8. The slide fastener according to claim 1, wherein the terminal portion of the fastener element is provided with an accommodating recess (26) that accommodates a core thread of the fastener tape of the engagement-partner fastener stringer when the paired left and right fastener stringers are coupled.

9. The slide fastener according to claim 1, wherein $0.62<R/(R+S)<0.83$ is satisfied where in a direction parallel to the axis, R indicates a maximum width of the base portion, and S indicates a minimum interspace of adjacent base portions of fastener elements on the same fastener tape.

10. The slide fastener according to claim 1 in which the paired left and right fastener stringers are closed by frontward movement of the slider and are opened by rearward movement of the slider, the front-rear direction being identical to the movement direction of the slider along the axis, wherein the fastener element has a first recess that is recessed at an opposite side of the engaged recess and at a same side as the engaging protrusion, and wherein an interspace between a vertex position of the engaging protrusion and a bottom position of the first recess in the front-rear direction is substantially same as an interspace between a rearmost point of the terminal portion and a bottom position of the engaged recess in the front-rear direction.

11. A slide fastener comprising:

a pair of left and right fastener stringers, wherein each fastener stringer includes a fastener tape and a plurality of fastener elements attached to the fastener tape, each fastener element including a base portion secured to the fastener tape and a terminal portion positioned opposite to the base portion, the fastener element extending along a left-right direction between the base portion and the terminal portion;

at least one slider that moves frontward to close the pair of left and right fastener stringers and moves rearward to open the pair of left and right fastener stringers, wherein:

the slide fastener has an axis defining a movement direction of the at least one slider relative to the plurality of fastener elements and along the pair of left and right-fastener stringers, each of the left and right fastener elements is bent or curved along the axis so as to have an engaging protrusion at a front side of the fastener element and an engaged recess at a rear side of the fastener element, the engaging protrusion and the engaged recess being respectively protruded and recessed on the axis within a maximum width of a base end surface of the base portion along the axis, the fastener element at one side of the left and right sides is provided with a first recess between the engaging protrusion and the base portion, the first recess being configured to receive a first protuberance that is protruded rearward and is provided on the fastener element at the other side of the left and right sides, and in the respective left and right fastener elements, the engaging protrusion is provided at a position shifted closer to the base portion than the first protuberance in the left-right direction, and the first recess is positioned at a position shifter closer to the base portion than the engaged recess in the left-right direction.

12. The slide fastener according to claim 11, wherein the fastener element has an intermediate portion including bent or curved portion between the terminal portion and the base portion, said engaging protrusion and said engaged recess being provided at the intermediate portion.

13. The slide fastener according to claim 11, wherein the fastener element at one side of the left and right sides has at least one displacement-restricting portion that prevents displacement, along an up-down direction, of the fastener element at the other side of the left and right sides.

14. A slide fastener comprising:

a pair of left and right fastener stringers, wherein each fastener stringer includes a fastener tape and a plurality of fastener elements attached to the fastener tape, each fastener element including a base portion secured to the fastener tape and a terminal portion positioned opposite to the base portion, each fastener element extending along a left-right direction between the base portion and the terminal portion; and at least one slider for opening and closing the pair of left and right fastener stringers, wherein:

the slide fastener having an axis defining a movement direction of the at least one slider relative to the plurality of fastener elements and along the pair of left and right fastener stringers, each of the fastener elements at the left and right sides has an intermediate portion including bent or curved portion between the terminal portion and the base portion, wherein the bent or curved portion is bent or curved along the axis, the intermediate portion has an engaging protrusion and an engaged recess which are respectively protruded and recessed on the axis within a maximum width of the base end surface of the base poriton along the axis, and the fastener element at one side of the left and right sides has at least one displacement-restricting portion that prevents displacement, along an up-down direction, of the fastener element at the other side of the left and right sides.

15. The slide fastener according to claim 14, wherein the engaging protrusion includes an angular portion positioned on the axis, and the engaged recess includes a concavity that is positioned on the axis and is shaped complementary to the angular portion.

16. The slide fastener according to claim 14, wherein the terminal portion of the fastener element is provided with a protuberance protruding in a same direction as the engaging protrusion with an amount of protruding less than an amount of protruding of the engaging protrusion.

17. The slide fastener according to claim 14, wherein the fastener element has a locking wall by which a locking pawl of the slider can be locked, and the engaging protrusion protrudes from the locking wall.

18. The slide fastener according to claim 14, wherein the base portion is configured to cause an opposite rotational moment to reduce a rotational moment caused in accordance with engagement of the engaging protrusion and the engaged recess, when the paired left and right fastener stringers are pulled apart in the left-right direction.

19. The slide fastener according to claim 18, wherein the base portion has at least one notch or hole that reaches a core thread of the fastener tape.

20. The slide fastener according to claim 18, wherein the base portion has a first leg provided at a side of the engaged recess and a second leg provided at a side of the engaging protrusion, a contact area of the first leg with the fastener tape being greater than a contact area of the second leg with the fastener tape.

* * * * *